US009016681B2

(12) United States Patent
Mizubata et al.

(10) Patent No.: US 9,016,681 B2
(45) Date of Patent: Apr. 28, 2015

(54) SHEET STORAGE APPARATUS AND IMAGE FORMATION SYSTEM USING THE APPARATUS

(71) Applicant: Nisca Corporation, Minamikoma-gun, Yamanashi (JP)

(72) Inventors: Tsuyoshi Mizubata, Tokyo (JP); Naoya Nakayama, Tokyo (JP); Daiki Komiyama, Yamanashi (JP); Hisashi Osada, Yamanashi (JP); Kenji Yoshida, Yamanashi (JP); Eiji Fukasawa, Yamanashi (JP)

(73) Assignee: Nisca Corporation, Minamikoma-Gun, Yamanashi (JP)

( * ) Notice: Subject to any disclaimer, the term of this patent is extended or adjusted under 35 U.S.C. 154(b) by 0 days.

(21) Appl. No.: 13/633,539

(22) Filed: Oct. 2, 2012

(65) Prior Publication Data

US 2013/0093134 A1 Apr. 18, 2013

(30) Foreign Application Priority Data

Oct. 7, 2011 (JP) ..... 2011-223042

(51) Int. Cl.

| | |
|---|---|
| ***B65H 37/04*** | (2006.01) |
| ***B65H 29/22*** | (2006.01) |
| ***B65H 29/14*** | (2006.01) |
| ***B65H 31/30*** | (2006.01) |
| ***B65H 31/34*** | (2006.01) |
| ***G03G 15/00*** | (2006.01) |

(52) U.S. Cl.

CPC ..... *B65H 29/22* (2013.01); *B65H 29/145* (2013.01); *B65H 31/3027* (2013.01); *B65H 31/34* (2013.01); *B65H 2301/4213* (2013.01); *B65H 2404/1442* (2013.01); *B65H 2404/166* (2013.01); *B65H 2404/693* (2013.01); *B65H 2701/18292* (2013.01); *B65H 2801/27* (2013.01); *G03G 15/6552* (2013.01)

(58) Field of Classification Search

USPC ..... 270/58.07, 58.08, 58.11, 58.12, 58.16, 270/58.17; 399/407, 410

See application file for complete search history.

(56) References Cited

U.S. PATENT DOCUMENTS

| | | | | |
|---|---|---|---|---|
| 7,461,837 | B2 * | 12/2008 | Saito et al. | 270/58.07 |
| 7,607,659 | B2 * | 10/2009 | Fukatsu et al. | 271/220 |
| 7,731,169 | B2 * | 6/2010 | Saito | 270/58.12 |

(Continued)

FOREIGN PATENT DOCUMENTS

| | | |
|---|---|---|
| JP | 2002-264560 | 9/2002 |
| JP | 2007-168965 | 7/2007 |
| JP | 2011-073805 | 4/2011 |

*Primary Examiner* — Patrick Mackey

(74) *Attorney, Agent, or Firm* — Manabu Kanesaka

(57) ABSTRACT

To provide a sheet storage apparatus for enabling sheets that are carried out of an image formation apparatus or the like on the upstream side to be loaded and stored in a predetermined position with a correct posture neatly at high speed, a sheet discharge roller and a reverse roller spaced a distance are disposed in a sheet discharge outlet and a tray, a kick member is provided to be swingable in a vertical direction passing a sheet discharge path of a sheet discharged from the sheet discharge outlet, and a posture of the kick member is controlled by shift means. The shift means controls the kick member among a waiting posture retracted upward from the sheet discharge path, an engagement posture for imposing a load on the sheet to engage, and an actuation posture dropping onto the tray together with the sheet.

13 Claims, 12 Drawing Sheets

(56) References Cited

U.S. PATENT DOCUMENTS

| | | | | |
|---|---|---|---|---|
| 7,866,649 | B2 * | 1/2011 | Saito et al. | 270/58.12 |
| 7,976,004 | B2 * | 7/2011 | Kimura | 270/58.11 |
| 7,992,856 | B2 * | 8/2011 | Saito | 270/58.11 |
| 8,439,342 | B2 * | 5/2013 | Okamoto et al. | 270/58.11 |
| 8,602,405 | B2 * | 12/2013 | Okamoto et al. | 270/58.11 |
| 2006/0208411 | A1 * | 9/2006 | Saito et al. | 270/58.07 |
| 2008/0054552 | A1 * | 3/2008 | Saito et al. | 271/221 |
| 2009/0261521 | A1 * | 10/2009 | Okamoto et al. | 270/37 |

* cited by examiner

SHEET FRONT END DETECTION

SHEET DISCHARGE

SHEET CONTACT

SHEET DROPPING

SHEET ALIGNMENT

SHEET BUNCH CARRYING-OUT

SHEET STORAGE APPARATUS AND IMAGE FORMATION SYSTEM USING THE APPARATUS

TECHNICAL FIELD

The present invention relates to a sheet storage apparatus for collecting sheets fed from an image formation apparatus or the like on a placement tray disposed on the downstream side of a sheet discharge outlet, and an image formation system using the apparatus, and more particularly, to improvements in a sheet storage apparatus for enabling sheets that are continuously carried out to be stacked and collected in a predetermined position promptly (with high-speed storage).

Generally, this type of sheet storage apparatus is known as a stack apparatus which collects sheets that are carried out of an image formation apparatus on a placement tray disposed on the downstream side of a sheet discharge outlet to load and store on the tray, or a post-processing apparatus which binds a bunch of sheets collated on a tray to perform post-processing, and then, stores the sheets on a stack tray on the downstream side.

As a sheet discharge mechanism thereof, a level difference is formed below the sheet discharge outlet to provide the placement tray, and a sheet from a sheet discharge roller of the sheet discharge outlet is dropped onto the tray and stored. Then, in the tray are disposed a regulating stopper that strikes a sheet rear end to regulate, a take-in roller (alignment roller; the same in the following description) that carries the dropped sheet toward the stopper, and a reverse roller. The take-in roller is disposed immediately below the sheet discharge outlet, and the reverse roller is disposed in front in the sheet discharge direction.

Further, a sheet discharge sensor is provided in the sheet discharge outlet, and the reverse roller is lowered onto the tray from a position retracted upward from the tray after a predetermined feed time since the signal that the sheet front end is detected, while being rotated in the sheet discharge direction. Subsequently, when the sheet rear end passed through the sheet discharge outlet, the reverse roller is rotated in the sheet-discharge opposite direction using a signal from the sensor, and feeds the sheet rear end to the take-in roller.

The sheet that is fed into the take-in roller is struck at the rear end against the strike stopper and regulated. In this position is disposed a post-processing apparatus such as a stapler apparatus (binding apparatus). Then, the post-processed sheet bunch is stored on the stack tray disposed on the downstream side of the placement tray.

Such a sheet discharge structure is provided with a kick mechanism which forcibly drops the sheet onto the tray at timing at which the sheet rear end passes through the sheet discharge outlet, in dropping the sheet rear end from the sheet discharge outlet onto the tray to store.

This is because of preventing a remaining jam from occurring with the sheet rear end caught in the sheet discharge roller, while preventing drop of the sheet rear end from delaying so as not to cause the sheet to be bent and taken in the take-in roller on the tray.

Conventionally, for example, in Patent Document 1, an arm-shaped member for supporting the reverse roller to be swingable up and down is disposed in the sheet discharge outlet, and the support member is provided with the kick member for forcibly dropping the sheet rear end.

Then, in a stage in which the sheet rear end passes through the sheet discharge outlet, the reverse roller is lowered to a lower sheet engagement position from an upper waiting position, and switchback-transports the sheet in the sheet-discharge opposite direction. Concurrently therewith, the kick member guides the sheet rear end to the nip clearance of the take-in roller.

Meanwhile, Patent Document 2 discloses a mechanism for arranging the kick member and the reverse roller moving up and down in the sheet discharge outlet, and moving the reverse roller and the kick member up and down separately.

In this Document, the kick member is configured to kick the sheet rear end with a front end portion of the arm swinging on the shaft. A rotating cam is provided at a base end portion of the kick member, and by rotating the rotating cam with an actuating solenoid, the kick member swings up and down.

Patent Document 3 discloses a lever mechanism in the sheet discharge outlet for forcibly dropping the sheet rear end toward the take-in rotating body on the tray below.

The Document discloses the rotating cam that swings the kick member (assist arm) to drop the sheet rear end to the take-in rotating body on the tray from a waiting position retracted above a sheet discharge path. Then, the rotating cam is coupled to a driving motor, the sheet front end is detected by a sensor provided in the sheet discharge outlet, and at timing at which the sheet rear end passes through the sheet discharge outlet, the kick member is lowered. The actuation timing of the kick member is performed at driving timing of a motor (that is shared as a motor moving up and down on the tray).

In any of the above-mentioned apparatuses, the kick member for forcibly dropping the sheet is disposed in the sheet discharge outlet, and at timing at which the sheet rear end passes through the sheet discharge outlet, the kick member is lowered onto the tray from the upper waiting position to forcibly drop the sheet rear end.

At this point, in the apparatus of Patent Document 1, the kick member is configured to be integral with the reverse roller moving up and down, and both of the members are positioned on the tray at the same time. Meanwhile, in the apparatuses in Patent Document 2 and Patent Document 3, the kick member is moved up and down by the actuating solenoid or driving motor independently of the up-and-down mechanism of the reverse roller.

[Patent Document 1] Japanese Patent Application Publication No. 2011-073805

[Patent Document 2] Japanese Patent Application Publication No. 2002-264560

[Patent Document 3] Japanese Patent Application Publication No. 2007-168965

When the mechanism of Patent Document 1 is used, since the reverse roller and the kick member operate so as to concurrently hit the sheet onto the tray from the sheet discharge outlet, the posture of the sheet sometimes becomes distorted significantly, and the misalignment acting on the sheet concurrently by the roller and the kick member may affect lower sheets that are already stored.

In using the mechanisms of Patent Documents 2 and 3, the reverse roller and the kick roller are lowered onto the tray separately (at different timing), and after engaging the sheet front end in the uppermost sheet on the tray by the reverse roller, the sheet rear end is dropped by the kick member to be taken in the take-in roller. At timing at which the sheet rear end is taken in the take-in roller, the kick member moves up and is retracted above the path not to interfere with the succeeding sheet.

Conventionally, up-and-down motion control of the kick member is performed using a detection signal of a sensor disposed in the sheet discharge outlet. For example, in the apparatus of Patent Document 1, the front end of the sheet is detected by a sensor disposed in the sheet discharge path, and using the detection signal as a reference, after a predicted time the sheet front end arrives at the position of the reverse roller, the reverse roller and the kick member are lowered from the waiting positions onto the tray.

Therefore, when the reverse roller moves down on the tray, there occurs an inconvenience (non-arrival) that the sheet front end does not arrive at the roller position yet or timing deviation (excessive transport) that the sheet front end significantly runs over the roller position.

This non-arrival is caused by delay by slide transport between the sheet discharge roller and the sheet, and meanwhile, the excessive transport is caused by actuation delay (delay of startup of the driving motor, etc.) of the reverse roller. The same defects also occur in the apparatus of Patent Document 2.

Further, in the apparatus of Patent Document 1, in returning the kick member from the actuation position on the tray to the upper retracted position, since the kick member moves up integrally with the reverse roller at the same time, fluctuations sometime occur between timing at which the kick member is retracted from the sheet discharge outlet so as to carry out the succeeding sheet and timing at which the reverse roller carries the sheet to the regulating stopper.

Therefore, conventionally, successive transport is performed with a sufficient interval provided between the preceding sheet and the succeeding next sheet. Reductions in operation efficiency due to such transport also prevent efficiency of the apparatus from being increased.

Further, in the apparatus of Patent Document 3, for the kick member that forcibly drops the sheet rear end in the sheet discharge outlet, the timing is controlled by rotation of the driving motor. The timing of motor control is made using the detection signal from the sheet sensor as a reference.

When the kick member in the sheet discharge outlet is moved up and down by the rotating cam, actuating solenoid or the like, timing deviations always occur such as transport delay of the sheet and delay of actuation of the kick member.

Conventionally, with consideration given to such timing deviations, the sheet is carried out at relatively low speed. Then, for the interval from the succeeding sheet, in consideration of the difference between apparatuses, rattle occurring during the use and others, the succeeding sheet is carried out with the interval sufficiently increased. These considerations result in reductions in efficiency of speed of image formation, post-processing or the like.

It is an object to the present invention to provide a sheet storage apparatus for enabling sheets that are carried out of an image formation apparatus or the like on the upstream side to be loaded and stored in a predetermined position with a correct posture neatly at high speed.

Furthermore, it is another object of the invention to provide an image formation system for enabling a series of operation of from image formation to post-processing to be handled at high speed.

SUMMARY OF THE INVENTION

To attain the above-mentioned objects, the present invention is characterized by arranging a sheet discharge roller and a reverse roller spaced a distance in a sheet discharge outlet and a tray, providing a kick member to be swingable in a vertical direction passing a sheet discharge path of a sheet discharged from the sheet discharge outlet, and controlling a posture of the kick member with shift means. The shift means is characterized by controlling the posture of the kick member among a waiting posture retracted upward from the sheet discharge path, an engagement posture for imposing a load on the sheet to engage, and an actuation posture dropping onto the tray together with the sheet.

As the action, the kick member is shifted from the waiting posture to the engagement posture with the sheet nipped between the sheet discharge roller and the reverse roller, and in this state, the sheet rear end is released from the sheet discharge roller. Then, by the weight of the kick member, the sheet rear end is forcibly dropped onto the tray, and it is thereby possible to solve the problems of a jam caused by the remaining sheet rear end, front end bend due to the take-in roller, and the like.

The invention provides a sheet discharge outlet for carrying out a sheet sequentially, a placement tray disposed in a level difference formed on the downstream side of the sheet discharge outlet to place the sheet dropped from the sheet discharge outlet, a sheet discharge roller disposed in the sheet discharge outlet, a reverse roller capable of moving up and down between an actuation position for engaging in the sheet on the placement tray and a retracted position retracted upward, an alignment roller that aligns the sheet dropped from the sheet discharge outlet to a predetermined position on the placement tray, and a kick member disposed between the sheet discharge roller and the reverse roller to forcibly drop the sheet rear end carried out of the sheet discharge outlet toward the alignment roller positioned downward.

The kick member is configured to swing among a waiting posture retracted upward from a sheet carried from the sheet discharge outlet to the up-and-down roller, an engagement posture for imposing a load on the sheet nipped by each of the sheet discharge roller and the alignment roller, and an actuation posture for forcibly dropping the sheet rear end released from the sheet discharge roller.

The kick member is coupled to shift means for changing the posture from the waiting posture to the engagement posture, and the shift means is provided with an engagement portion for holding the kick member in the waiting posture, while changing the posture from the actuation posture to the waiting posture.

The invention is to arrange the kick member swingably in the vertical direction crossing the sheet discharge path of the sheet carried out of the sheet discharge outlet, engage the kick member on the sheet from the upper waiting position so that the load acts with the sheet nipped by the sheet discharge roller on the upstream side and the reverse roller on the downstream side, and forcibly drop the sheet rear end by the weight of the kick member when the sheet rear end separates from the roller, and has the following effects.

In the sheet carried out of the sheet discharge outlet, when the rear end separates from the roller, the sheet drops on stacked sheets on the tray by the weight of the kick member, and therefore, the sheet reliably drops on the tray without being caught in the roller periphery. Therefore, the sheet rear end does not cause a jam by subsequent back transport of the reverse roller.

Concurrently therewith, even when the sheet rear end curls to warp, the sheet is guided to the alignment roller (take-in roller, described later) by the kick member, and therefore, the sheet front end does not cause a front end bend (rear end bend) by the sheet discharge roller.

Concurrently therewith, the shift means enables the kick member to make the retracted position retracted upward from the sheet carried out of the sheet discharge outlet, the engagement posture for engaging (getting) on the sheet to carry out, and the operation for returning to the waiting position from the actuation position on the tray, and thus enables the kick member to return to the waiting position at optimal timing independently of the reverse roller up-and-down operation, and it is possible to set a carrying-out interval of a succeeding sheet to be short, and to improve operation efficiency.

BRIEF DESCRIPTION OF DRAWINGS

FIG. 10(*b*) is a configuration explanatory view of a punch unit;

DETAILED DESCRIPTION OF PREFERRED EMBODIMENTS

Figure 1A:
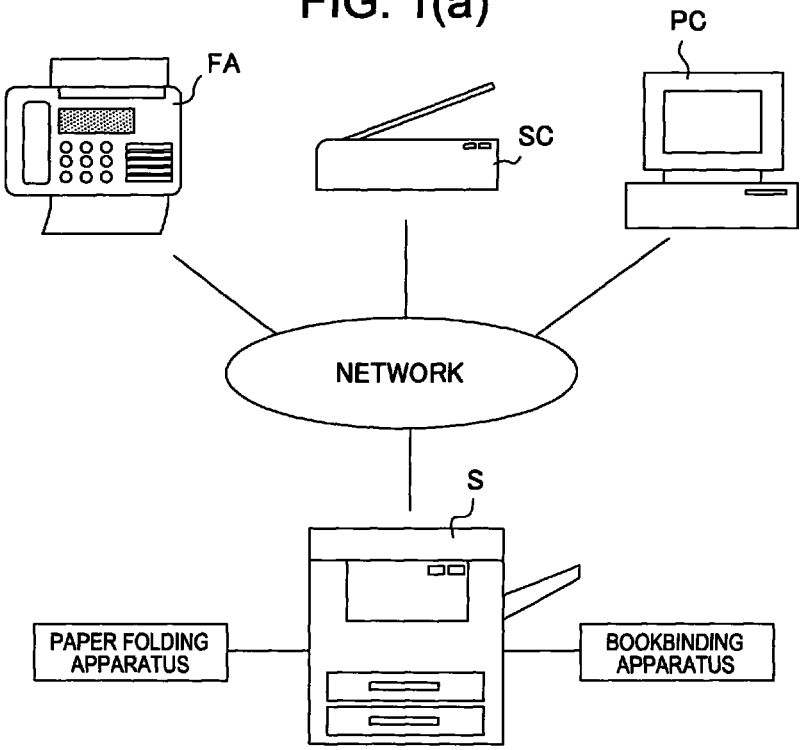
FIG. 1 shows a computer network with an image formation system according to the invention installed, where FIG. 1(*a*) is a configuration diagram of the system, FIG. 1(*b*) shows one Embodiment (unit integrated configuration) of the image formation system, and FIG. 1(*c*) shows another Embodiment (standalone configuration) different from one Embodiment.
Figure 1B:
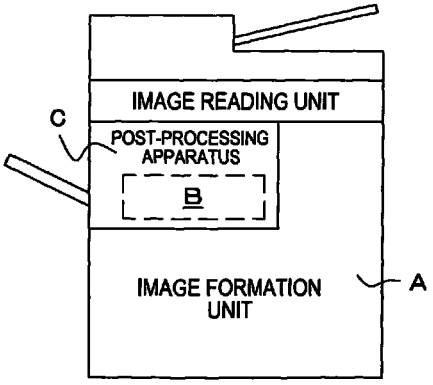
Figure 1C:
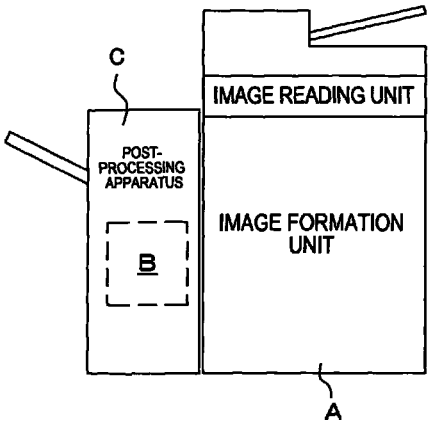

The present invention will specifically be described below based on preferred Embodiments shown in drawings. The invention relates to a sheet storage apparatus B that loads and stores sheets that are sequentially fed, and an image formation system S provided with the apparatus B. FIG. 1 shows the image formation system as an output terminal of a computer network.

The image formation system S is comprised of an image formation apparatus A that forms an image on a sheet, and a post-processing apparatus C that incorporates the sheet storage apparatus B that stores the sheet with the image formed. As shown in FIG. 1(*b*), the image formation system S is comprised of a unit structure in which the image formation apparatus A and the post-processing apparatus C are mounted in a common apparatus housing.

Alternatively, as shown in FIG. 1(*c*), the system S is comprised of a standalone structure in which the image formation apparatus A and the post-processing apparatus C are mounted in respective different housings. PC shown in FIG. 1(*a*) denotes a computer apparatus, FA denotes a facsimile apparatus, and SC denotes a scanner apparatus.

n addition, the post-processing apparatus C is configured as a stack apparatus that loads and stores sheets that are sequentially carried out, or a post-processing apparatus that performs post-processing on a sheet that is carried out, and then loads and stores the sheet.

Hereinafter, the invention will specifically be described as the image formation system S for collating and collecting sheets on which images are formed in the image formation apparatus A to perform binding processing in the post-processing apparatus C, and then, storing the sheets on a stack tray.

[Image Formation System]

Figure 2:
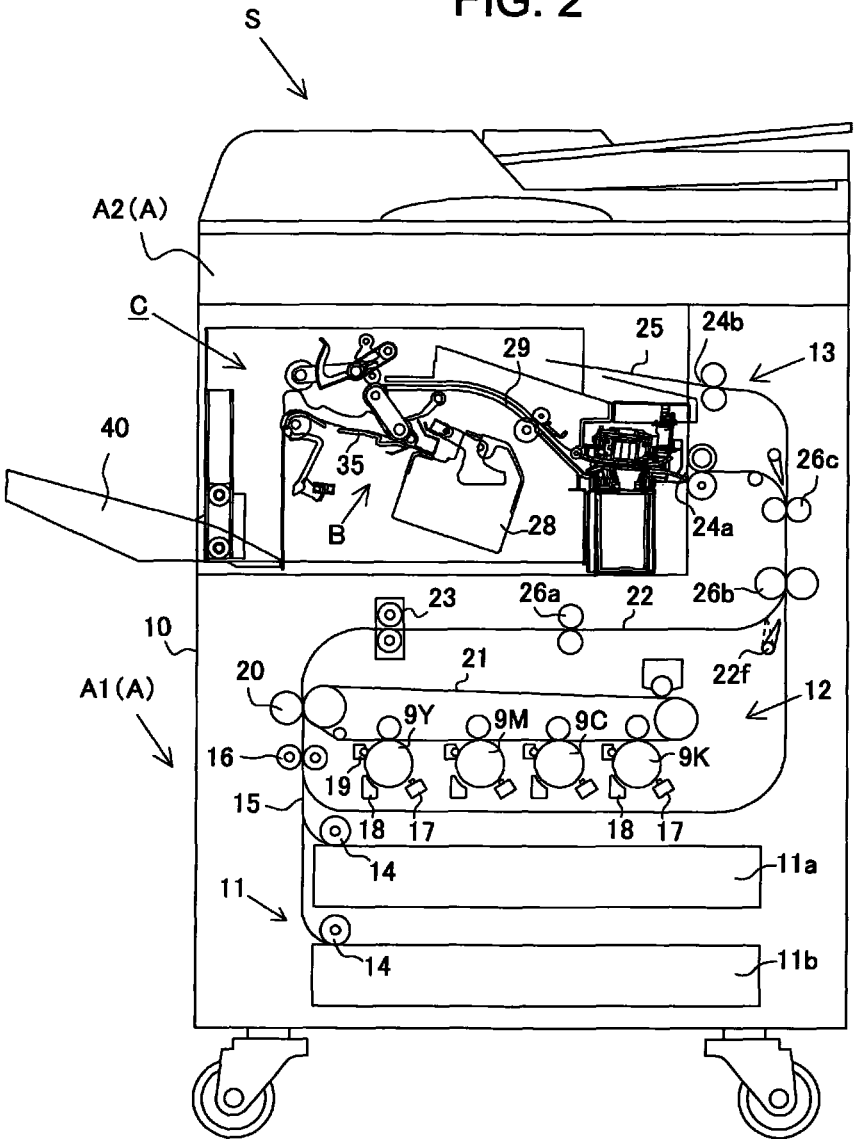
FIG. 2 is an explanatory view showing the entire configurations of an image formation apparatus and a post-processing apparatus in the system of FIG. 1.

FIG. 2 shows the image formation system S. This system is comprised of the image formation apparatus A and the post-processing apparatus C, and the sheet storage mechanism (apparatus) B is incorporated into the post-processing apparatus C. Each apparatus is integrally mounted in an apparatus housing 10. Further, the image formation apparatus A is comprised of an image formation unit A1 and an image reading unit A2.

The image formation unit A1 is comprised of a paper feed section 11, image formation section 12 and sheet discharge section 13, and is mounted in the apparatus housing (exterior casing) 10. The paper feed section 11 is comprised of a single or a plurality of paper feed cassettes 11*a*, 11*b*, and each cassette is configured to be able to store sheets of a different size, and is provided with a paper feed roller 14 for feeding out a sheet, and separation means (separation hook, separation roller, etc.) for separating sheets on a sheet-by-sheet basis (not shown). The paper feed cassettes 11*a*, 11*b* are installed in the apparatus housing 10 to be loadable and unloadable.

A sheet fed out of the paper feed section 11 is guided to a paper feed path 15, and this path is provided with a register roller 16 for causing the sheet to temporarily wait. It is possible to provide the paper feed path 15 with a large-capacity cassette to be a configuration for guiding transported sheets to the register roller 16, or to provide the path with a manual tray to manually feed a sheet.

The image formation section 12 is disposed above the paper feed section 11, and forms an image on a sheet sent from the register roller 16. As an image formation mechanism, it is possible to adopt various types of printing mechanisms such as ink jet printing, offset printing, and ink ribbon printing. The image formation section 12 shown in the figure indicates an electrostatic image formation mechanism. Around a photosensitive drum 9 are arranged a printing head 17, developing device 18 and cleaner 19.

The printing head 17 is comprised of an emitter of light beams such as laser emission and LED emission, and forms a latent image on the photosensitive drum. The developing device 18 adds toner ink to the latent image. The toner ink added to the drum surface is transferred to the sheet fed out of the register roller 16 by a charger 20.

The apparatus as shown in the figure indicates a color image formation mechanism, and toner ink formed on YMCK four drums (9Y, 9M, 9C, 9K) is transferred to a transfer belt 21, and image-combined. The image ink transferred to the transfer belt 21 is transferred onto the sheet by the transfer charger 20. In a sheet discharge path 22 provided with the transfer charger 20, a fuser 23 is provided and heats and fuses the image transferred onto the sheet. The sheet discharge path 22 carries out the sheet from the image formation section 12 to a sheet discharge outlet 24.

In addition, the sheet discharge outlet 24*a* indicates a sheet discharge outlet for carrying out a sheet toward the post-processing apparatus (unit) C from the sheet discharge path 22, and the sheet discharge outlet 24*b* shown in the figure indicates a sheet discharge outlet for carrying out a sheet to a switchback path of a circulating path (duplex path) 25, described later.

The apparatus housing 10 is provided with the sheet discharge path 22 for guiding a sheet from the image formation section 12 to the sheet discharge outlet 24. Concurrently therewith, the circulating path (duplex path) 25 is disposed to reverse the side of the sheet fed from the sheet discharge path 22 to feed again to the register roller 16. The sheet discharge path 22 and circulating path 25 form the sheet discharge section 13.

In addition, in the case of an apparatus configuration without the post-processing apparatus C, described later, being provided, a sheet discharge tray (not shown) for loading and storing sheets is disposed on the downstream side of the sheet discharge outlet 24.

In the apparatus of FIG. 2, the image reading unit A2 is disposed above the image formation unit A1. The image reading unit A2 incorporates a platen to place an original image, and a scanner mechanism for irradiating the original on the platen with light to perform photoelectric conversion on the reflected light.

Particularly, in the apparatus of FIG. 2, the image formation section 12, sheet discharge section 13 and image reading unit A2 are disposed upward in this order. Then, the sheet discharge section (post-processing apparatus C, described later) and image reading unit A2 are supported by frame strength of the image formation unit A1.

In addition, in FIG. 2, "26" (26*a*, 26*b*, 26*c*) shown in the figure denotes a transport roller of a sheet disposed in the sheet discharge path 22, and is coupled to a driving motor, not shown.

[Post-Processing Apparatus]

Figure 3:
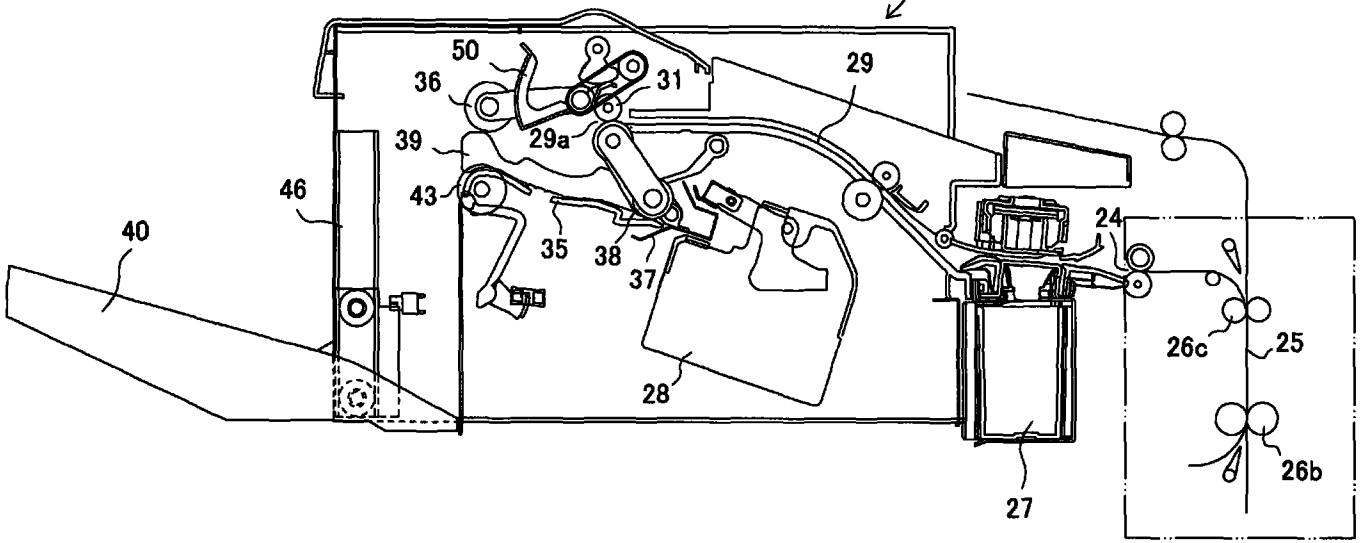
FIG. 3 is an explanatory view of a sheet discharge mechanism in the post-processing apparatus of FIG. 2.

For the post-processing apparatus C, FIG. 2 shows the entire configuration, and FIG. 3 shows the enlarged structure of principal part. The post-processing apparatus C performs post-processing on a sheet fed from the image formation apparatus A to store in a stack tray 40.

As post-processing means, known are a punch unit that punches a file hole in the sheet, staple unit that binds sheets which are collated and collected, stamp unit that puts a stamp on the sheet, folding processing unit that folds the sheet with the image formed, and the like, which are combined as appropriate and configured according to apparatus specifications.

The apparatus of FIG. 2 incorporates a staple unit 28 that performs binding processing on sheets, and a punch unit 27. The configuration will be described below.

In the Embodiment as shown in FIG. 3, the post-processing apparatus C is incorporated into a sheet discharge area formed inside the housing of the image formation apparatus A to be built-in. Therefore, the post-processing apparatus C is not provided with an exterior casing (the post-processing apparatus C may be equipped with a different exterior casing from that of the image formation apparatus A.) In this unit frame are disposed a carrying-out path 29, processing tray 35 and stack tray 40.

The carrying-out path 29 has a path configuration continued to the sheet discharge path 22 of the image formation apparatus A, and has a carrying-out exit (hereinafter, referred to as a sheet discharge outlet) 29*a*. The carrying-out path 29 is comprised of a linear path crossing the apparatus housing 10 substantially in the horizontal direction.

On the downstream side of the carrying-out path 29, the processing tray 35 is disposed while forming a level difference d from the sheet discharge outlet 29*a*. Further, the punch unit 27 is disposed in an entrance portion of the carrying-out path 29, and punches a file hole in sheets that are sequentially carried in.

Further, in the carrying-out path 29 are disposed path transport means (transport roller) 30 for transporting a sheet to the downstream side and a sheet discharge roller 31 and sheet detection sensor S1 in the vicinity of the sheet discharge outlet 29*a*.

The level difference d is formed between the sheet discharge outlet 29*a* and the processing tray 35, and a sheet rear end is dropped from the sheet discharge roller 31 of the sheet discharge outlet 29*a* onto the processing tray to store. In between the sheet discharge roller 31 and the processing tray 35 are disposed a reverse roller 36 that reverses the transport direction of a sheet that is carried on the processing tray, and a take-in roller (alignment rotating body; the same in the following description) 38 that causes the sheet entering onto the processing tray to strike a position regulating stopper 37.

The stack tray 40 is disposed on the downstream side of the processing tray 35, and stores sheets (bunch) subjected to post-processing on the processing tray 35. Described sequentially are a sheet discharge mechanism for discharging a sheet to the processing tray 35, and a stack mechanism for storing sheets subjected to post-processing.

[Sheet Discharge Mechanism]

A sheet that is carried out of the sheet discharge outlet 29*a* is configured to be supported by the processing tray 35 and the stack tray 40 in the shape of a bridge. This is because of making the processing tray 35 small and compact by supporting the sheet front end by the stack tray 40, while supporting the sheet rear end by the processing tray 35. The processing tray 35 may be configured in the shape (dimensions) to place a sheet by itself.

The sheet discharge outlet 29*a* and the processing tray 35 are spaced the level difference d apart and thus are disposed at a distance vertically. The level difference d is to make a load amount on the processing tray large capacity and ensure arrangement space of a mechanism (the take-in roller 38 and paper-pressing guide described later) for aligning sheets on the processing tray.

Further, the processing tray 35 is configured in the shape for supporting only the sheet rear end portion, instead of the dimension shape for supporting the whole of the sheet. This is because of adopting the structure for bridge-supporting the sheet from the sheet discharge outlet 29*a* at the front end portion by the stack tray 40 and at the rear end portion by the processing tray 35. Therefore, the stack tray 40 moves up and down in the load direction, and the processing tray 35 is fixed to a predetermined position.

In the processing tray 35, the position regulating stopper 37 is disposed in the sheet rear end portion (that may be the sheet front end portion). The staple unit 28 is disposed to perform post-processing on sheets aligned by the position regulating stopper 37.

Further, in the processing tray 35 is disposed sheet side alignment means 39 for width-shifting and aligning a sheet in the sheet-discharge orthogonal direction. The structure can adopt the already known method. For example, a pair of alignment plates are provided on the sides of a sheet, and it is possible to align with respect to the center reference by approaching and shifting the alignment plates to the sheet front end.

Above the processing tray 35, the sheet discharge outlet 29*a* and sheet discharge roller 31 are disposed in the substantially center portion of the tray, and the reverse roller 36 is spaced a distance L (distance from the sheet discharge roller) apart in front (on the downstream side) of the sheet discharge outlet 29*a*. Further, the take-in roller 38 is disposed immediately below (that is an approximate position) of the sheet discharge outlet 29*a*.

The reverse roller 36 is required to be disposed on the downstream side of the sheet discharge outlet 29*a*, engage in the uppermost sheet on the processing tray, carry the carried-in sheet to the reverse direction, and be able to wait in a waiting position retracted from the path of the sheet extending from the sheet discharge outlet 29*a* to the processing tray 35.

Therefore, the reverse roller 36 is comprised of a rotating body such as a roller and belt that rotate, and is configured to be able to move up and down between the waiting position Wp above the processing tray and an actuation position Ap for engaging in the sheet on the processing tray.

Then, the reverse roller 36 is required to carry the sheet in the sheet discharge direction, and shift in the sheet-discharge opposite direction (switchback roller structure) in a stage in which the sheet rear end separates from the sheet discharge roller 31.

As a different structure of the reverse roller 36, the reverse roller 36 may be positioned in a state for waiting above the tray when the sheet enters onto the processing tray from the sheet discharge outlet 29*a*, and move down to a position for engaging in a sheet on the processing tray immediately after the sheet rear end passes through the sheet discharge roller 31. Then, in the actuation position Ap, the reverse roller 36 is also capable of rotating to carry the sheet in the sheet-discharge opposite direction (reverse roller structure).

Accordingly, in the former switchback roller structure, the reverse roller 36 is coupled to a forward/backward rotating motor. Meanwhile, in the latter reverse roller structure, the reverse roller 36 is coupled to a one-direction rotating motor.

The reason why the reverse roller 36 that transports a sheet onto the processing tray is disposed in front of the sheet discharge outlet 29*a* is to feed the sheet which is carried onto the processing tray in the sheet-discharge opposite direction to align in a post-processing position.

Further, concurrently therewith, when the sheet is guided to the stack tray 40 on the downstream side without performing post-processing on the processing tray 35, required is a roller rotating body which transfers and transports the sheet fed from the sheet discharge roller 31 to the stack tray 40 (at the time of a straight sheet discharge mode).

Figures 4A, 4B:
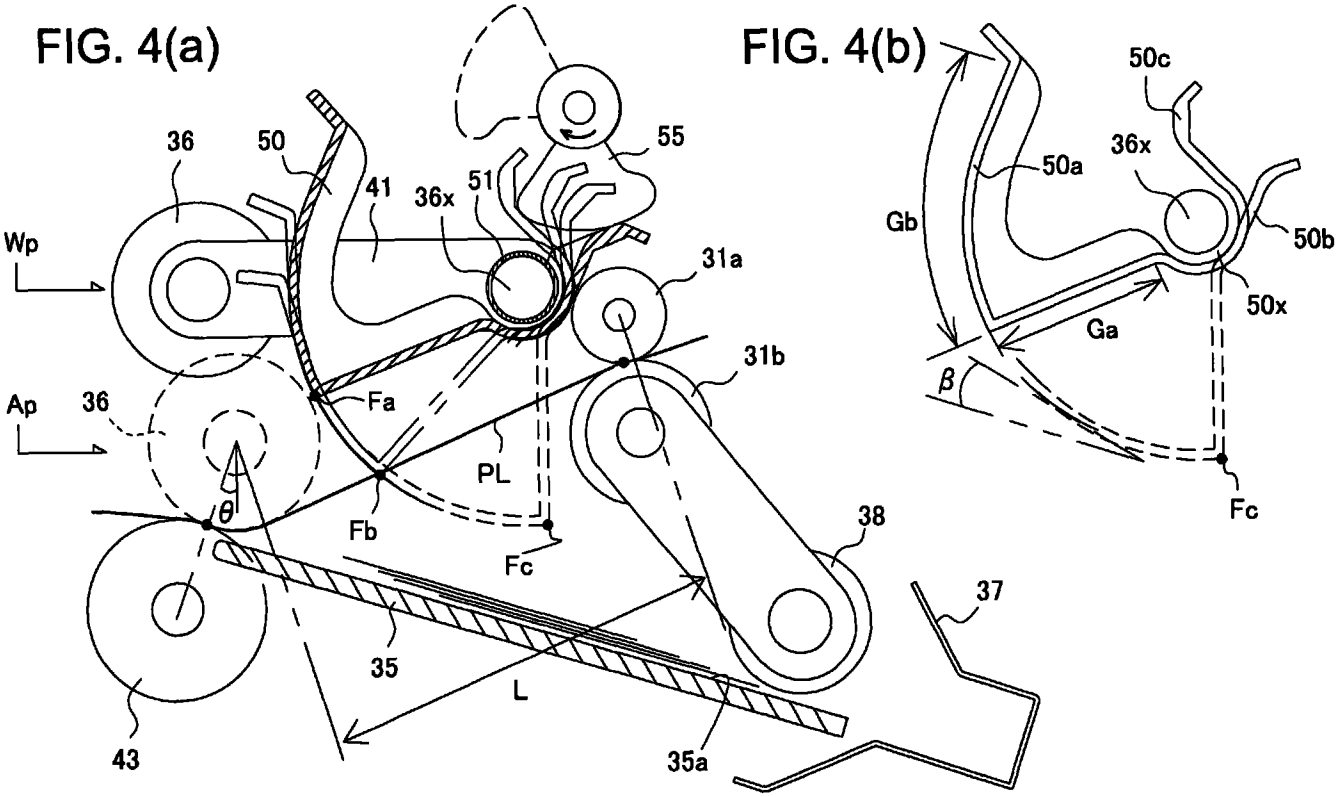
FIG. 4 contains explanatory views of a kick mechanism in the apparatus of FIG. 2, where FIG. 4(*a*) shows an explanatory view of the detailed configuration, and FIG. 4(*b*) is a configuration diagram of a kick member.

In the reverse roller 36, as shown in FIG. 4, a spindle portion 36*x* is provided in an apparatus frame, and an arm member 41 swingable about the spindle is provided. A roller 42 is supported by the arm member 41 to be rotatable, and rotation of a driving sleeve (not shown) of the spindle portion 36*x* is conveyed to the roller with a transmission belt, not shown. The driving sleeve is freely fitted into the spindle portion 36*x*, and rotation of the forward/backward rotating motor M1 is directly conveyed to the sleeve.

Further, the arm member 41 is axially supported by the spindle portion 36*x* to be swingable, while being coupled to an actuating motor M2. Then, the arm member 41 incorporates a clutch member (not shown) to rotate to above the processing tray by rotation in one direction of the actuating motor M2, while rotating to below the processing tray by rotation in the opposite direction.

The clutch mechanism of the arm member 41 will be described. For example, a spring clutch is wound around the sleeve freely fitted in the spindle portion 36*x*. Then, when the spring clutch is rotated to the contraction side, for example, in a counterclockwise direction (ccw), the sleeve rotates in synchronization with rotation of the actuating motor M2, and the arm member 41 swings and rotates from the actuation position Ap to the waiting position Wp.

Meanwhile, when the spring clutch is rotated to the loose direction, for example, in a clockwise direction (cw), the sleeve and the arm member 41 mesh with each other in a free fit state. By this means, the reverse roller 36 moves down from the waiting position Wp to the actuation position Ap by its weight.

A layout relationship between the sheet discharge roller 31 and the reverse roller 36 will be described. The sheet discharge roller 31 is comprised of a pair of rollers disposed in the sheet discharge outlet 29*a*, and a driving motor is coupled to one of the rollers. The reverse roller 36 is spaced the distance L away from the sheet discharge roller 31. The distance L is set to be shorter than the length in the transport direction of the sheet to transport.

The reverse roller 36 is disposed to be able to move up and down between the upper waiting position Wp and the lower actuation position Ap, and the waiting position Wp is set in a position that does not inhibit progress of the sheet discharged from the sheet discharge outlet 29*a*.

Meanwhile, the actuation position Ap is arranged on the uppermost sheet (on the sheet that is carried in from the sheet discharge outlet 29*a*) stacked on the processing tray.

In the following description, for convenience sake, a "reverse roller position" indicates an engagement point of the reverse roller engaging in the sheet on the processing tray.

In this case, it is possible to adopt either the method of rotating and starting the reverse roller 36 in the sheet discharge direction after lowering the roller from the waiting position Wp to the actuation position Ap, or the method of lowering the roller from the waiting position Wp to the actuation position Ap while rotating the roller in the sheet discharge direction.

In the former case, when the reverse roller 36 comes into contact with the sheet, since the roller is in a halt state, there is no risk of occurrence of wrinkle, skew and the like in the sheet. Meanwhile, in the latter case, when the reverse roller 36 comes into contact with the sheet, since the roller is already rotating, it is possible to perform high-speed sheet discharge operation.

A driven roller 43 is disposed on the processing tray side opposed to the reverse roller 36. The driven roller 43 is disposed in a position for sandwiching the sheet on the processing tray with the periphery of the reverse roller 36 to engage.

Particularly, as shown in FIG. 4, the apparatus shown in the figure is inclined an angle e in a direction n-n orthogonal to the angle of the processing tray plane (sheet placement surface 35*a*). This is because of raising a sheet bunch loaded on the processing tray upward in carrying out the sheet bunch to the stack tray side by the driven roller 43 and the reverse roller 36.

By this means, it is possible to strengthen the transport force in carrying out the sheet bunch from the processing tray 35 to the stack tray 40.

[Sheet Rear End Kick Mechanism]

A guide mechanism for guiding the sheet stably is required in between the sheet discharge roller 31 and the reverse roller 36. The guide mechanism needs the guide function for guiding the sheet front end from the sheet discharge roller position to the reverse roller position, the function for dropping the sheet rear end to the processing tray side so that the sheet rear end is not caught in the sheet discharge roller 31, and the function for guiding the sheet rear end to the take-in roller 38, described later.

[Take-in Roller Mechanism]

On the processing tray 35, it is necessary to carry a sheet onto the processing tray by the reverse roller 36, and concurrently therewith, to cause the sheet to strike the predetermined position regulating stopper 37 to position. Therefore, the take-in roller 38 is disposed in the level difference d between the sheet discharge roller 31 and the processing tray 35.

The take-in roller 38 comes into contact with the uppermost sheet on the processing tray to carry to the position regulating stopper 37. The take-in roller 38 is comprised of a rotating body such as an endless belt, and presses the uppermost sheet with a certain pressure corresponding to the load amount of sheets on the processing tray.

Therefore, the take-in roller 38 is supported to be swingable to move up and down corresponding to the load amount of sheets on the processing tray. In the roller as shown in the figure, the take-in roller 38 is supported by a bracket 44 axially supported swingably by the rotating shaft 31*x* of the sheet discharge roller (driven roller) 31*b*. The take-in roller 38 is coupled to a driving motor M3 (not shown).

It is also possible to convey a rotating force to the take-in roller 38 from the sheet discharge roller (driven roller) 31*b*, and in the roller shown in the figure, the take-in roller 38 is driven to rotate with the driving motor M3 different from the sheet discharge roller 31*b*.

The take-in roller 38 carries sheets collected on the processing tray to the stack tray 40 side after the post-processing. At this point, it is necessary to rotate the take-in roller 38 in the opposite direction to the rotation direction, and for that, the sheet discharge roller 31*b* needs to be rotated in the sheet-discharge opposite direction.

Therefore, by separately providing a rotation driving motor of the sheet discharge roller 31*b* and the driving motor M3 of the take-in roller 38, during sheet discharge operation for carrying out a sheet subjected to the post-processing from the processing tray 35 by the take-in roller 38, it is possible to feed the succeeding sheet onto the processing tray from the sheet discharge outlet 29*a* by the sheet discharge roller 31*b*.

[Kick Mechanism]

In between the sheet discharge outlet 29*a* and the reverse roller 36 are needed a guide mechanism for guiding a sheet from the sheet discharge outlet 29*a* to the reverse roller position, and another guide mechanism for guiding the sheet rear end from the sheet discharge outlet 29*a* to the take-in roller 38.

Particularly, in the sheet discharge mechanism having a large level difference between the sheet discharge outlet 29*a* and the processing tray 35, when the sheet rear end drops onto the processing tray, the sheet is sometimes caught in the periphery of the sheet discharge roller 31 to cause a sheet jam.

Therefore, in the apparatus as shown in the figure, a kick-mechanism comprised of the following structure is disposed between the sheet discharge outlet 29*a* and the reverse roller 36. FIG. 4 specifically shows the structure.

Before describing the kick mechanism, described is the behavior of the sheet that is carried out onto the processing tray from the sheet discharge outlet 29*a*.

The sheet front end carried out of the sheet discharge outlet 29*a* receives the transport force from the sheet discharge roller pair, 31*a*, 31*b*, and is fed out toward the actuation position Ap (at this point, which is an engagement expected position since the reverse roller 36 is in the waiting position Wp) of the reverse roller 36 on the processing tray.

Subsequently, when the sheet front end passes through the actuation position Ap, the reverse roller 36 moves down and provides the sheet with the transport force. In this state, the sheet is nipped respectively by the sheet discharge roller pair, 31*a*, 31*b*, and the reverse roller 36, and is provided with the transport force. Then, after the sheet rear end passes through the sheet discharge outlet 29*a*, the sheet rear end drops onto the loaded sheets on the processing tray.

After the sheet rear end drops onto the processing tray, the sheet enters the take-in roller 38 by backward rotation (back-feed) of the reverse roller 36, and is struck and regulated against the position regulating stopper 37 by the transport action of both rollers.

In such a sheet discharge mechanism, when the sheet rear end is caught in the periphery of the sheet discharge roller 31 and causes a jam, such a defect occurs that the sheet rear end is bent, taken in the take-in roller 38, and results in a rear end bend.

Concurrently therewith, with consideration given to the fact that the sheet rear end undergoes effects of the wind from the outside and the like, sheets are collected by sluggish dropmotion, and collection efficiency is significantly reduced.

To solve such defects, in the invention, the following kick mechanism 50 is disposed between the sheet discharge outlet 29*a* and the reverse roller 36.

As shown in FIG. 4, in the kick mechanism, a kick member comprised of a swing arm member 50 is disposed rotatably in the apparatus frame.

The mechanism is mentioned as the swing arm member when the following specific structure is described, while being mentioned as the kick member when the whole is shown. The swing arm member 50 is configured to reciprocate between an upper waiting posture Fa and a lower actuation posture Fc so as to cross a sheet discharge path line PL.

A base end portion 50*x* of the swing arm member 50 is supported swingably by the spindle portion 36*x* in the apparatus frame, and the spindle portion 36*x* is supported swingably by the common shaft of the spindle portion 36*x* of the arm member 41 of the reverse roller 36 as described previously via a free fit collar 51. This is because of simplifying the apparatus, and the member may be supported by a spindle different from the spindle of the reverser roller 36.

In the swing arm member 50 are formed a front end arm portion 50*a* and a rear end arm portion 50*b* via the spindle portion 36*x*. The front end arm portion 50*a* is configured to be swingable among the waiting posture Fa (solid line in FIG. 4) retracted above the sheet discharge path line P1, an engagement posture Fb (chained line in FIG. 4) to engage on a sheet passing through the sheet discharge path line PL, and the actuation posture Pc (dashed line in FIG. 4) positioned below the sheet discharge path line above the processing tray.

As shown in FIG. 4(*b*), in the front arm portion 50*a* are formed a first guide surface (first guide member) Ga and a second guide surface (second guide member) Gb.

When the front end arm member 50*a* is of the waiting posture Fa, the first guide surface Ga guides the sheet from the sheet discharge outlet 29*a* to the actuation position Ap of the reverse roller 36 along the sheet discharge path line PL.

Further, when the front end arm member 50*a* is of the actuation posture Fc above the processing tray, the second guide surface Gb guides the sheet to the take-in roller 38.

In addition, in the first and second guide surfaces Ga, Gb, the guide length (Gb in FIG. 4) of the second guide surface is set to be longer (Ga<Gb) than the guide length (Ga in FIG. 4) of the first guide surface.

This is because in the sheet guided from the sheet discharge outlet 29*a* to the reverse roller 36, it is essential only that the front end is guided to the direction of the reverse roller (to be exact, the actuation position Ap) on the downstream side, and the relatively short guide length is set (concurrently therewith, by setting the guide length at a short length, the apparatus is made compact.)

In contrast thereto, the second guide surface Gb needs to feed the sheet curved in the shape of a loop on the processing tray to the take-in roller 38 positioned on the downstream side.

In other words, when the reverse roller 36 feeds the sheet back in the direction of the position regulating stopper 37, the sheet rear end is sometimes not taken in the take-in roller 38 and thus does not receive the transport force from the roller. In this case, the sheet rear end is curved in the shape of a loop, and the defect occurs that the sheet enters the take-in roller 38 with the front end bent.

Therefore, by setting the second guide surface Gb to be longer than the first guide surface Ga, the second guide surface Gb prevents the sheet rear end from becoming deformed significantly in the shape of a loop, and the sheet rear end enters under the take-in roller 38 smoothly.

Further, the front end arm portion 50*a* changes from the upper waiting posture Fa to the lower actuation posture Fc so as to cross the sheet discharge path line PL. At this point, the first guide surface Ga forcibly drops the sheet rear end released from the sheet discharge outlet 29*a* on sheets stacked on the processing tray.

Therefore, in the kick member 50, the first and second guide surfaces Ga, Gb perform the function of forcibly dropping the sheet rear end onto the processing tray immediately after the sheet rear end passes through the sheet discharge outlet 29*a* without any time lag, and the function of guiding the sheet rear end to the take-in roller 38 smoothly.

The first guide surface Ga is disposed in the direction along the sheet discharge path line PL in the kick member 50 held in the waiting posture Fa. Meanwhile, in the actuation posture Fc, the second guide surface Gb is configured at an angle (13 angle shown in the figure) inclined in between the uppermost sheet collected on the processing tray and the sheet rear end dropped from the sheet discharge outlet 29*a*.

The second guide surface Gb shown in the figure is formed in the shape of a curved sector. The rear end portion 50*b* of the swing arm member 50 is provided with a passive engagement portion (cam engagement portion) 50*c* that engages in shift means 52, described later, and the portion shown in the figure is comprised of a plate-shape tongue piece.

Described is the position relationship between the kick member 50, sheet discharger roller 31 and reverse roller 36.

The sheet discharge roller 31 and reverse roller 36 are disposed in positions shorter than the transport-direction length of the sheet as described previously. The roller distance L as shown in FIG. 4 is set to be shorter than the transport-direction length of a minimum-size sheet.

By this means, the sheet fed from the sheet discharge outlet 29*a* always forms the state nipped by both of the sheet discharge roller 31 and the reverse roller 36.

The kick member 50 is disposed between the sheet discharge roller 31 and the reverse roller 36, and is set at the engagement posture Fb to engage so as to impose the weight on the sheet nipped by both rollers. The engagement posture Fb is set between the waiting posture Fa and the actuation posture Fc (Fb in FIG. 4: chained-line state).

At the time of the engagement posture Fb, the sheet is acted upon by the nip force of the sheet discharge roller 31, the weight of the kick member 50, and the nip force of the reverse roller 36, and shifts in the sheet discharge direction by the transport forces of the sheet discharge roller 31 and reverse roller 36. At this point, when the weight of the kick member 50 acts so that the sheet falls on the processing tray, a transport failure occurs.

Therefore, as compared with the nip force (roller pressure× coefficient of friction) of the sheet discharge roller 31 and the nip force (roller pressure×coefficient of friction) of the reverse roller 36, the weight (mass×gravity) of the kick member 50 is set to be lower than the nip forces of both rollers.

Further, the circumferential velocity of the reverse roller 36 is set to be higher than the circumferential velocity of the sheet discharge roller 31, and at the same time, the pressure that the reverse roller 36 acts on the sheet is set to be lower than the pressure that the sheet discharge roller 31 acts on the sheet.

In such a force relationship, the sheet that is carried out of the sheet discharge outlet 29*a* is regulated by the circumferential velocity of the sheet discharge roller 31, and the reverse roller 36 slide-transports so as to pull the sheet front end. Then, the kick member 50 is configured to have the weight of the degree that does not warp (slacken) the sheet in this force relationship.

[Configuration of the Shift Means]

Figure 5A:
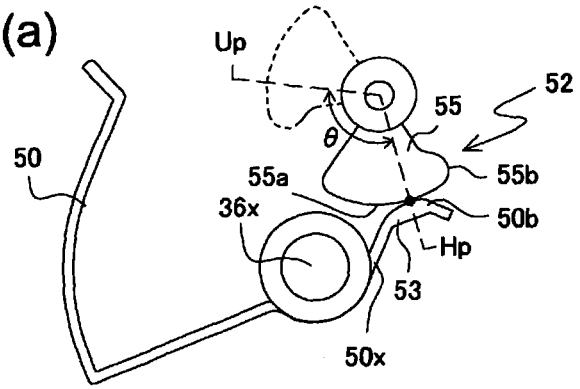
FIG. 5 contains configuration explanatory views of shift means in the sheet discharge mechanism of FIG. 2, where FIG. 5(*a*) shows an Embodiment of shift means using a cam mechanism, FIG. 5(*b*) shows an Embodiment of shift means using a lever mechanism, and FIG. 5(*c*) shows an Embodiment of means using a gear mechanism.
Figure 5B:
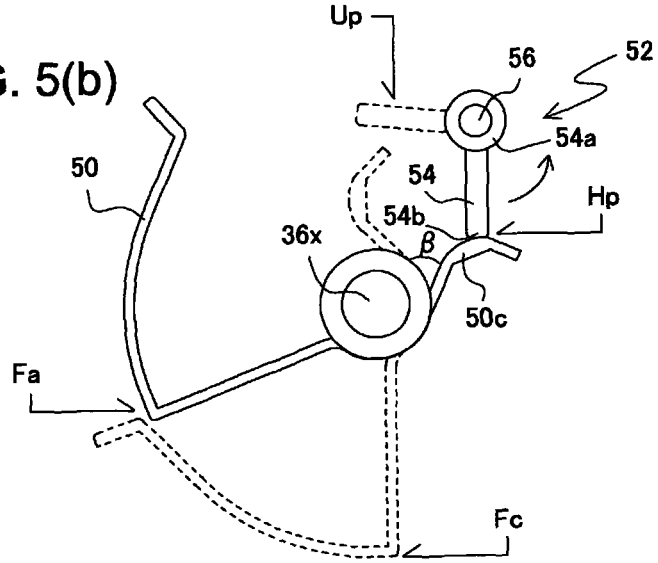
Figure 5C:
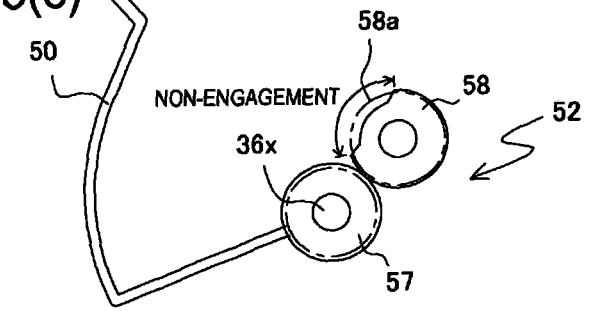

Described is the configuration the shift means 52 that causes the kick member 50 to reciprocate between the waiting posture Fa and the actuation posture Fc. FIG. 5(*a*) shows an Embodiment for causing the swing arm member 50 to reciprocate between the waiting posture Fa and the actuation posture Fc with a cam mechanism, FIG. 5(*b*) shows an Embodiment for causing the swing arm member 50 to reciprocate with a lever mechanism, and FIG. 5(*c*) shows an Embodiment for causing the swing arm member 50 to reciprocate with a gear mechanism.

In the cam mechanism as shown in FIG. 5(*a*), a cam engagement piece 53 is provided in the base end portion 50*x* of the swing arm member . The cam engagement piece 53 is formed in the shape as shown in the figure as a cam follower. A rotating cam 55 is disposed in a position for engaging in the cam engagement piece 53. The rotating cam 55 shown in the figure is supported rotatably in the spindle by the apparatus frame, and has a cam surface in the shape of a sector.

The rotating cam 55 is coupled to the actuating motor M2 (which is shared as the actuating motor that raises and lowers the reverse roller, but the cam may be rotated with an independent motor) as described previously, and is configured so that a rotation angle position can be detected with a position sensor and sensor flag, not shown. The actuating motor M2 is comprised of a forward/backward rotating motor which swings and moves a beforehand set angle θ, and conveys driving to the spindle portion 36*x* and the rotating cam 55.

Then, the rotating cam 55 is controlled to rest in a hold position Hp of the solid-line position in the figure, and a waiting position Up of the dashed-line position in the figure (see control means, described later).

When the rotating cam 55 is in the hold position Hp, the kick member 50 is positioned in the waiting posture Fa. When the rotating cam 55 is in the waiting position Up, the kick member 50 is free and in the engagement posture Fb or the actuation posture Fc.

In the rotating cam 55 are formed a posture holding cam surface 55*a* and a shift cam surface 55*b*. In the hold position Hp in which the posture holding cam surface 55*a* engages in the cam engagement piece 53, the swing arm member 50 is held in the waiting posture Fa.

Meanwhile, in the waiting position Up rotated a θ angle in a clockwise direction shown in the figure from the hold position Hp, the cam surface 55*a* and the cam engagement piece 53 are in a non-engagement state.

Then, when the cam rotates a θ angle in a counterclockwise direction shown in the figure from the waiting position Up, the shift cam surface 55*b* rotates the cam engagement piece 53 a predetermined angle to shift to the state of the solid line in FIG. 5(*a*). Thus, the rotating cam 55 is provided with the function of changing the kick member 50 from the waiting posture Fa to the engagement posture. Fb, and the function of shifting the kick member 50 (dashed-line state in FIG. 5(*a*)) positioned in the actuation position Fc to the waiting posture Fa, and when the kick member 50 is of the engagement posture Fb, forms a non-engagement state for causing the member to freely swing irrespective of the angle position of the rotating cam 55.

The shift means in FIG. 5(*b*) will be described. The kick member 50 is configured as in the former Embodiment, and the spindle portion 36*x* and cam engagement portion 50*c* are formed.

An actuating lever 54 is attached rotatably at a shaft 56 to the apparatus frame in a position opposed to the cam engagement portion 50*c*. In the actuating lever 54, a base end portion 54*a* is supported rotatably at the shaft 56 by the apparatus frame, and a front end portion 54*b* is disposed to engage in the cam engagement portion 50*c*.

In the state as shown in the figure, when the actuating lever 54 is rotated 360° in a counterclockwise direction, the cam engagement portion 50*c* rotates a predetermined angle, β angle, in a clockwise direction from the dotted-line state to the solid-line state. Then, the kick member 50 integrally having the cam engagement portion 50*c* changes the position from the actuation posture Fc to the waiting posture Fa. The shaft 56 of the actuating lever 54 is coupled to a shift motor M5 (for example, a pulse motor), not shown.

Then, by rotating the actuating lever 54 a predetermined angle with the pulse motor, the kick member 50 changes the position from the waiting posture Fa to the non-engagement posture, and then to the actuation posture (dotted-line state).

In addition, the shift motor of the actuating lever 54 is set to rotate the actuating lever 54 between the hold position Hp shown by the solid line and the waiting position Up shown by the dashed line in FIG. 5(*b*), using a position sensor and flag, not shown.

Further, a control apparatus, described later, is configured to rotate the actuating lever 54 in a counterclockwise direction shown in the figure to temporarily halt in the hold position Hp and the waiting position Up, and start rotation from the halt positions in response to timing of sheet discharge operation.

Accordingly, the actuating lever 54 holds the kick member 50 in the waiting posture Fa in the hold position Hp, and positions the kick member 50 in the engagement posture Fb until rotation to the waiting position Up. Further, when the level 54 rotates from the waiting position Up to the hold position Hp, the lever 54 changes the kick member 50 from the actuation posture Fc to the waiting posture Fa.

The shift means in FIG. 5(*c*) will be described. As in the shift means 52, the spindle portion 36*x* is formed in the kick member 50. In the spindle portion 36*x* is formed a driven gear 57 integral with the kick member 50.

A teeth-lack gear 58 meshing with the driven gear 57 is axially supported by the apparatus frame, and is rotated with a shift motor M6, not shown.

Then, when the teeth-lack gear 58 rotates i in a counterclockwise direction shown in the figure, and a teeth-lack portion 58*a* becomes non-engagement with the driven gear 57, the kick member 50 becomes a state of freely falling by its weight.

Thus, the shift means 52 is provided with the action of changing the kick member 50 from the waiting posture Fa to the engagement posture Fb, and the action of changing the kick member 50 from the actuation position Fc to the waiting posture Fa, and is comprised of the cam means 55, lever means 54 or gear means 58 so that the kick member 50 becomes a non-engagement state in the engagement posture Fb.

[Description of the Sheet Discharge Operation]

Figure 6A:
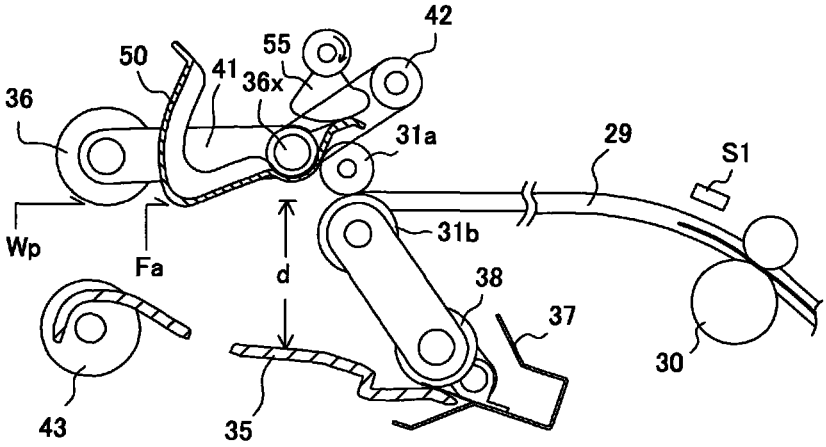
FIG. 6 contains explanatory views of sheet discharge operation states in the post-processing apparatus of FIG. 2, where FIG. 6(*a*) shows an explanatory view of a state in which the sheet front end is detected, and FIG. 6(*b*) is an explanatory view of a state in which the sheet front end is discharged.
Figure 6B:
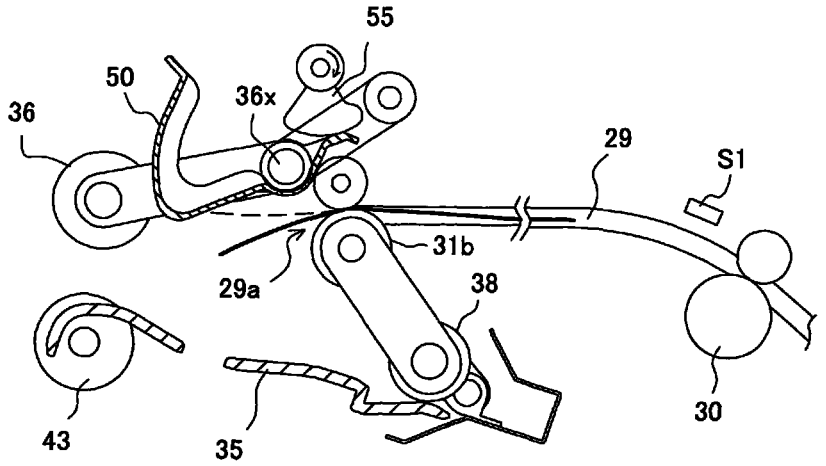

The sheet discharge operation in the sheet discharge mechanism will be described. FIG. 6(*a*) shows a state in which a sheet is carried in the carrying-out path 29. The sheet fed from the sheet discharge outlet 24*a* of the image formation apparatus A to the carrying-out path 29 of the post-processing apparatus C is fed toward the carrying-out exit (sheet discharge outlet) 29*a* by the path transport roller 30 disposed in the path.

At this point, the sheet detection sensor S1 detects the sheet front end. In this state in which the sheet is transported, the reverse roller 36 is held in the waiting position Wp, and at the same, the kick member 50 is held in the waiting posture Fa. The position hold of the kick member 50 is held in the position by a driving load of the shift means 52, lock mechanism and the like.

FIG. 6(*b*) shows an initial state in which the sheet is carried out onto the processing tray from the carrying-out exit (sheet discharge outlet) 29*a* of the carrying-out path 29. In the sheet fed from the sheet carrying-out path 29, the front end thereof is fed from the carrying-out exit 29*a* (sheet discharge outlet, the same in the following description) toward the actuation position Ap (position for engaging in the sheet on the processing tray) of the reverse roller 36.

At this point, the control means, described later, lowers the reverse roller 36 from the waiting position Wp to the actuation position Ap after a lapse of a predicted time the sheet front end passes through the actuation position Ap (predetermined delay time with reference to the time the sheet discharge sensor detects the sheet front end; Timer T1). This operation is performed by the actuating motor M1 (up-and-down motor) and a clutch (for example, spring clutch).

At this point, almost in tandem with control of the actuating motor M2 (before or after the reverse roller 36 arrives at the actuation position Ap), the control means drives and rotates the forward/backward rotation motor M1 in the forward direction. By this means, the reverse roller 36 shifts the sheet in the sheet discharge direction, leftward in FIG. 6. This state (descent of the reverse roller and forward rotation) is shown by dashed lines.

Figure 7C:
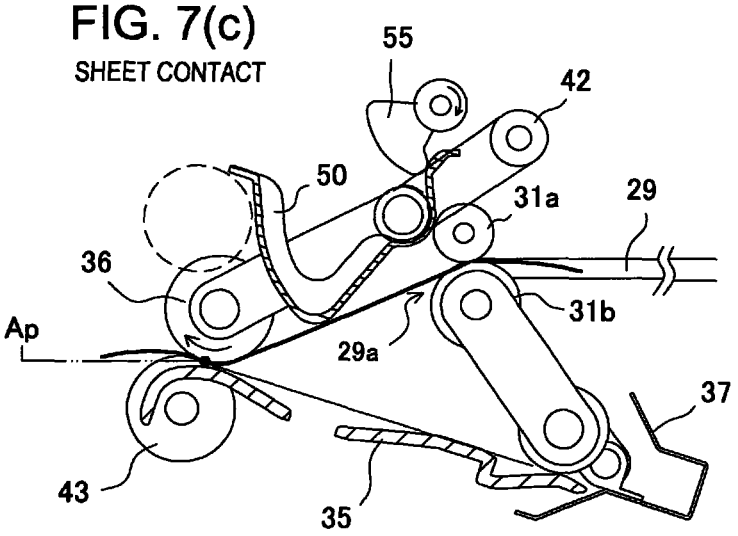
FIG. 7 contains explanatory views of sheet discharge operation states in the post-processing apparatus of FIG. 2, where FIG. 7(*c*) shows a state of an engagement posture in the kick member, and FIG. 7(*d*) is an explanatory view of a state of an actuation posture in the kick member.
Figure 7D:
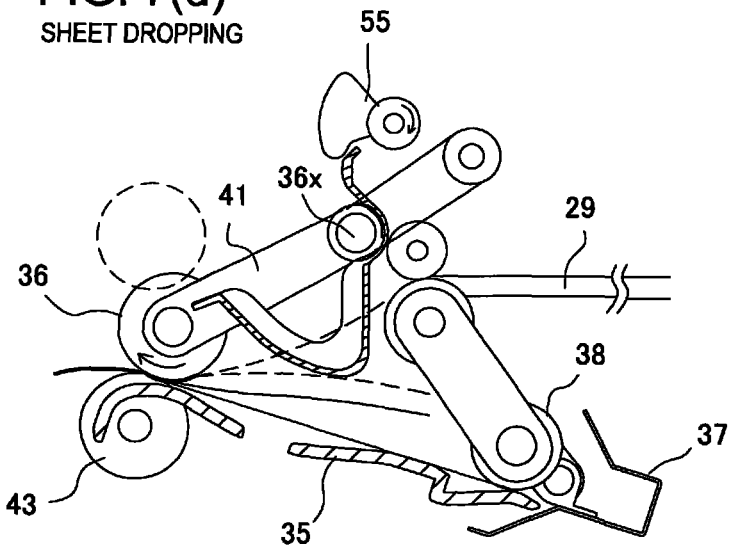

FIG. 7(*c*) shows a state in which the kick member 50 is shifted from the waiting posture Fa to the engagement posture Fb. The control means, described later, sets the actuation timing after a lapse of a predetermined delay time (timer time T2) since the front end detection signal of the sheet discharge sensor, and the timing is optimal timing slightly delayed from the descendent operation of the reverse roller 36. The operation for shifting the kick member 50 from the waiting posture Fa to the actuation posture Fc is performed by controlling driving means (shift motors M4 to M6) of the shift means (see FIGS. 5(*a*), 5(*b*) and 5(*c*)).

Then, the kick member 50 engages in the sheet on the sheet discharge path line by its weight. At this point, the sheet is acted upon by the nip force of the reverse roller 36 on the front end side, while being acted upon by the nip force of the sheet discharge roller pair 31 on the rear end side. Both nip forces are set for the force relationship exceeding the load of the kick member 50, and therefore, the sheet neither becomes misaligned nor falls by engagement of the kick member 50.

Next, FIG. 7(*d*) shows a state in which the sheet rear end is released from the sheet discharge roller pair 31. When the sheet rear end is released from the roller nip portion, the sheet rear end drops onto the sheets that are already stacked on the processing tray.

At this point, the kick member 50 is engaging in the sheet in the engagement posture Fb. As described previously, the engagement posture Fb is of the state that the kick member 50 freely falls around the spindle 35x. Therefore, the sheet rear end is dropped onto the loaded sheets on the processing tray forcibly by a strong force.

Accordingly, even when the sheet rear end is caught in the periphery of the sheet discharge roller pair 31, the sheet forcibly drops. By this means, it is possible to prevent a sheet jam from occurring by the caught sheet rear end.

In addition, the take-in roller 38 is rotating in sheet discharge direction, a counterclockwise direction shown in the figure, by the driving motor M3 (forward/backward rotation motor) different from the sheet discharge roller 31 as in a timing chart, described later. Concurrently therewith, the reverse roller 36 rotates in the opposite direction (back-feed) after a lapse of a predicted time the sheet rear end drops onto the processing tray.

By such sheet-discharge operation, the sheet is carried out above the processing tray from the sheet discharge outlet 29*a*, and immediately after the sheet rear end passes through the sheet discharge roller 31, forcibly drops onto the collected sheets on the processing tray 35. At the time before or after drop storage of the sheet rear end (concurrent timing is preferred), the reverse roller 36 is rotated backward, and reverses the transport direction of the sheet (back-feed of the sheet).

When the sheet rear end is taken in between the take-in roller 38 and the uppermost sheet on the processing tray, by rotation of the take-in roller 38, the sheet is fed to the position regulating stopper 37. The sheet fed to the position regulating stopper 37 is corrected in the width-direction position by a width-shift alignment mechanism, described later.

Figure 8E:
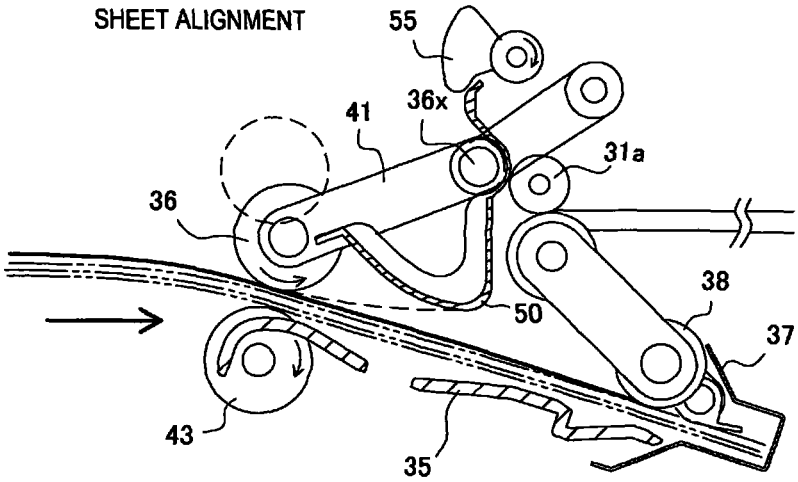
FIG. 8 contains explanatory views of sheet discharge operation states in the post-processing apparatus of FIG. 2, where FIG. 8(*e*) shows a state in which the sheet rear end arrives at a regulating stopper from a take-in roller, and FIG. 8(*f*) is an explanatory view of a state in which the kick member is returned to a waiting position from an actuation position.
Figure 8F:
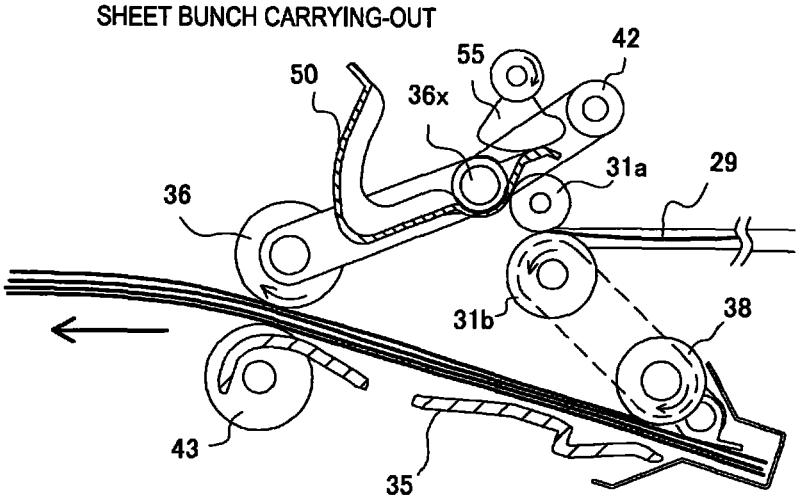

This state is shown in FIG. 8(*e*), and the sheet positioned in the position regulating stopper 37 by the take-in roller 38 is aligned by the width-shift alignment mechanism.

FIG. 8(*f*) shows a state in which the post-processing is applied to the sheets that are collated and collected on the processing tray, and then, the sheets (bunch) subjected to the post-processing are carried out to the stack tray 40 on the downstream side.

The sheets that are collated and collected on the processing tray are positioned by the position regulating stopper 37, and undergo binding processing by the staple unit 28 disposed in this position. After the binding processing, the sheet bunch on the processing tray is fed out to the stack tray 40 on the downstream side by sheet-discharge direction rotation of the reverse roller 36 and driven roller 43.

[Alignment Mechanism]

Figure 10A:
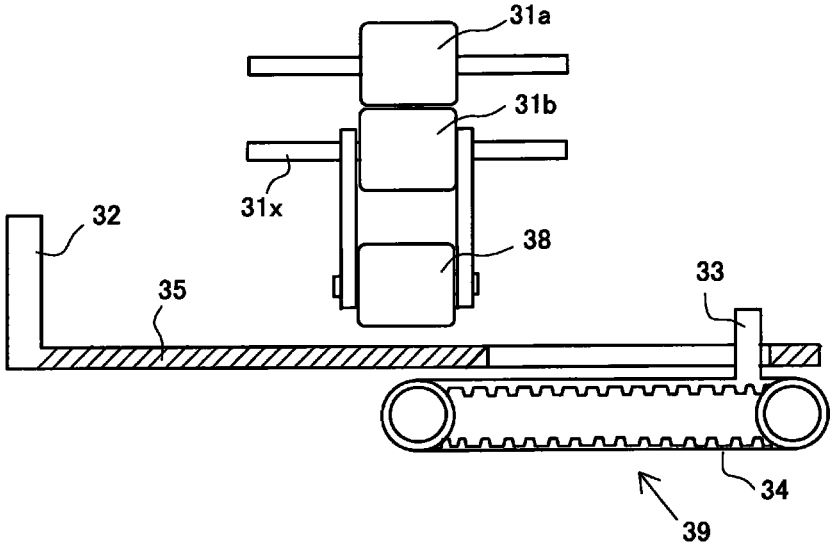
FIG. 10(*a*) shows a configuration explanatory view of alignment means.
Figure 10B:
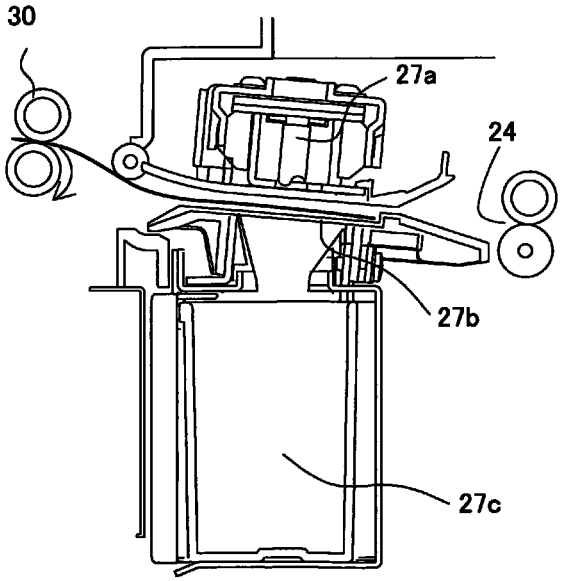

An alignment mechanism as shown in FIG. 10(*a*) will be described. The processing tray 35 is provided with the width-shift alignment mechanism for aligning the width direction of the sheet struck against the position regulating stopper 37 by the take-in roller 38. This mechanism aligns the sheet with respect to the center reference or one side reference.

The one side reference as shown in the figure will be described as an example. A fix regulating surface 32 is provided on one edge side of the sheet. A movable alignment plate 33 is disposed on the opposite side to the fix regulating surface 32 with the take-in roller 38 therebetween, and is configured to be movable in the width direction. The alignment plate 33 is coupled to a timing belt 34 coupled to an alignment motor M, not shown.

By this configuration, when the alignment motor M rotates forward and backward, the timing belt 34 reciprocates by a predetermined stroke, and the alignment plate 33 fixed to the belt approaches and separates from the fix regulating surface 32. The sheet is width-shifted and aligned with reference to the regulating surface 32 by reciprocating shift between the waiting position and the width-shift position.

The control means, described later, controls the alignment motor M and shifts the alignment plate 33 in the waiting position (solid-line position shown in the figure) to the width-shift position (dashed-line position shown in the figure) when a predetermined delay time (timer T3) has elapsed since a detection signal that the sheet rear end is detected by the sheet discharge sensor (sheet detection sensor) S1 described previously. After shifting the sheet to the predetermined position, the alignment plate 33 returns to the waiting position.

[Configuration of the Punch Unit]

In the carrying-out path 29, the punch unit 27 is disposed in a sheet carry-in portion Cl. The structure will be described. The punch unit 27 is comprised of a punch portion 27*a*, die portion 27*b* and waste box 27*c*.

In the punch portion 27*a*, a plurality of punch members is axially supported to be able to shift up and down, and shifts up and down by a cam mechanism so as to protrude to the sheet path. Across the path is disposed the die portion 27*b* having punch holes. Further, the waste box 27*c* is disposed below the die portion 27*b*.

[Configuration of the Stack Tray]

Figure 9:
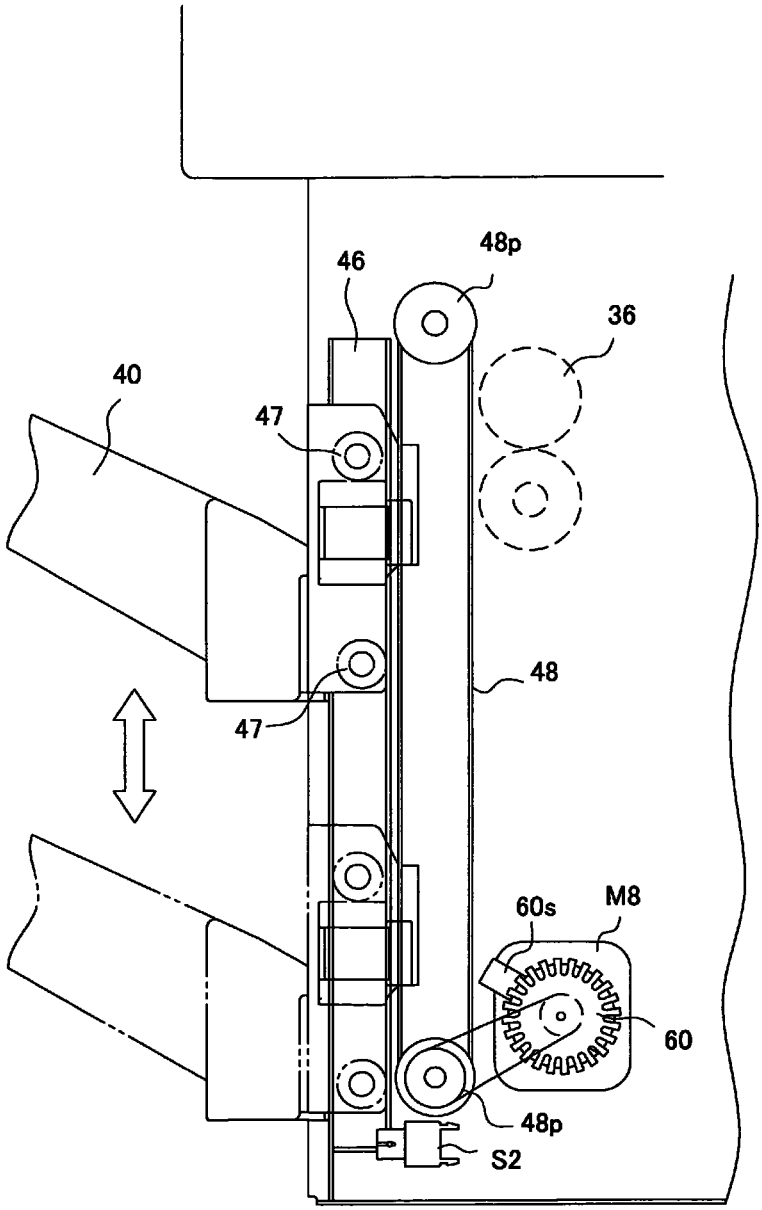
FIG. 9 is an explanatory view of an up-and-down mechanism of a stack tray in the post-processing apparatus of FIG. 2.

The stack tray 40 is provided on the downstream side of the processing tray 35. The stack tray 40 will be described according to FIG. 9. A guide rail 46 is fixed to a unit frame in the vertical sheet load direction, and the stack tray 40 is fitted and supported by the guide rail 46 to be able to move up and down.

"47" shown in the figure denotes a slide roller. The stack tray 40 is fixed to a belt 48 with teeth looped over a pair of upper and lower pulleys 48p. The belt 48 with teeth moves up and down by an up-and-down motor M8 coupled to the pulley 48p with teeth.

In addition, the up-and-down motor M8 is provided with an encoder 60 and an encode sensor 60s, and controls an up-and-downmotion difference of the stack tray 40.

In the stack tray 40, a lower limit sensor S2 and level sensor (not shown) are further disposed. The lower limit sensor S2 detects the lowest position of the stack tray 40, and detects a state in which the tray is full of sheets thereon. Meanwhile, the level sensor detects a height position of the uppermost sheet on the tray.

[Explanation of Post-processing Operation]

As described above, sheets that are carried out onto the processing tray 35 from the sheet discharge outlet 29*a* are sequentially stacked upward, and collated and collected. Subsequently, the control means, described later, executes the following operation.

The sheets collated and collected on the processing tray are positioned by the position regulating stopper 37, and undergo binding processing by the staple unit 28 disposed in this position. After the binding processing, the sheet bunch on the processing tray is fed out to the stack tray 40 on the downstream side by rotation in the sheet discharge direction of the reverse roller 36 and driven roller 43.

In addition, the invention describes the roller driving method for rotating the reverse roller 36 forward and backward in the same direction as the sheet discharge direction and in the opposite direction, but it is also possible to adopt a driving method for rotating the reverse roller 36 only in the sheet discharge direction.

In this case, the take-in roller 38 is preferably comprised of a mechanism of flexible rotating member such as a timing belt.

[Control Configuration]

Figure 11:
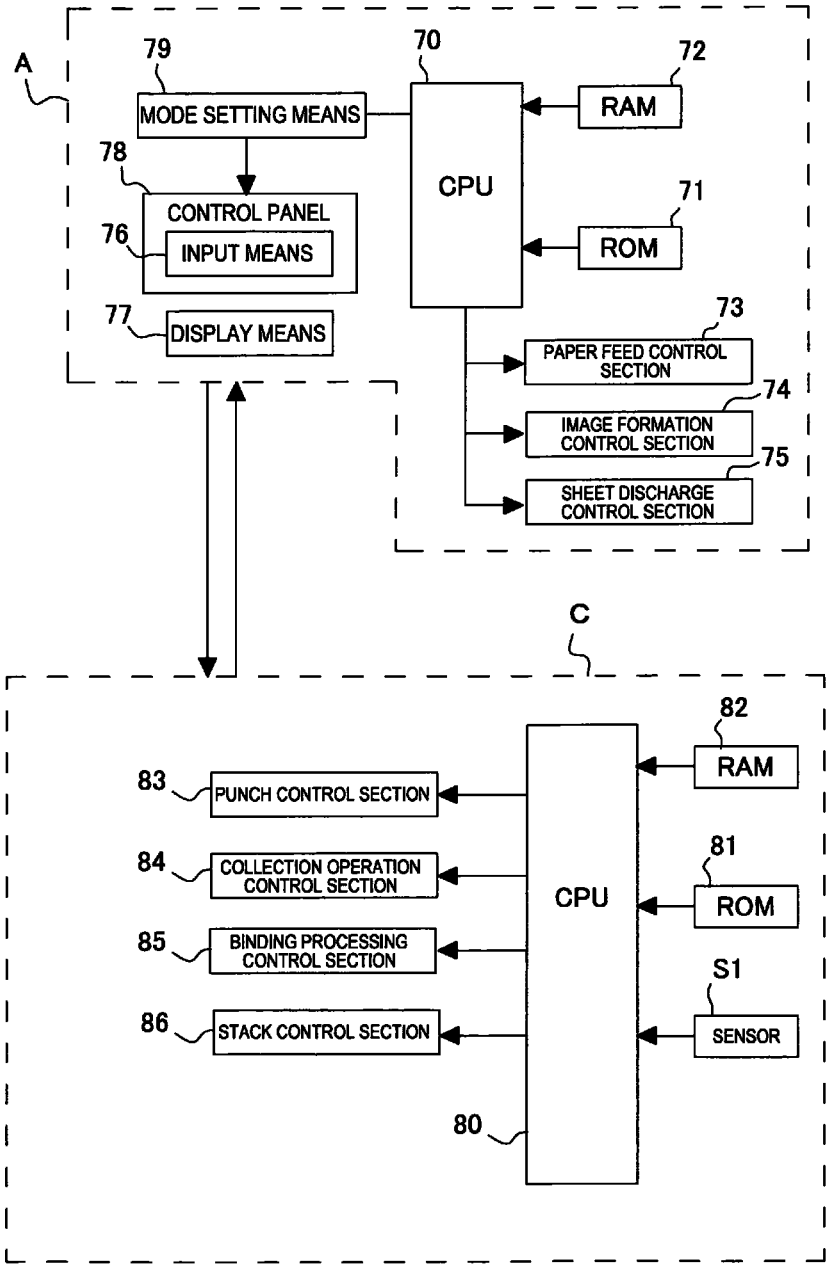
FIG. 11 is an explanatory block diagram of a control section in the post-processing apparatus of FIG. 2.

A control configuration of the image formation system as shown in FIG. 2 will be described according to FIG. 11. The image formation apparatus A is provided with a control CPU 70, and the control CPU 70 is connected to ROM 71 for storing operation programs, and RAM 72 for storing control data.

Then, the control CPU 70 is provided with a paper feed control section 73, image formation control section 74, and sheet discharge control section 75. Concurrently therewith, the control CPU 70 is connected to display means 77 and a control panel 78 provided with input means 76.

Further, the control CPU 70 is configured to select a "printout mode" and a "post-processing mode". In the "printout mode", the sheet with the image formed is stored in the stack tray 40 without performing any finish processing.

Meanwhile, in the "post-processing mode", sheets with the image formed are collated and collected, and stored in the stack tray 40 after performing binding processing. The sheet storage apparatus B according to the invention is built into the post-processing apparatus C.

The post-processing apparatus C is provided with a post-processing control CPU 80, and the CPU 80 is connected to ROM 81 for storing operation programs, and RAM 82 for storing control data. Then, the control section of the image formation apparatus A transfers, to the control CPU 80, sheet size information, sheet discharge instruction signal, and a mode setting command for the post-processing mode and the printout mode.

The post-processing control CPU 80 is provided with a punch control section 83 that performs punching processing on the sheet with the image formed, a collection operation control section 84 that collates and collects sheets on the processing tray 35, a binding processing control section 85, and a stack control section 86.

[Operation Explanation]

The control CPU 70 of the image formation apparatus A executes the following image formation operation according to the image formation program stored in the ROM 71. Similarly, the post-processing control CPU 80 of the post-processing apparatus C executes the following post-processing operation according to the post-processing program stored in the ROM 81.

[Image Formation Operation]

When a "one-side printing mode" is selected, the control CPU 70 picks a sheet of a set size from the paper feed cassette 11*a* (11*b*) to feed to the register roller 16. Around the time of feeding, the control CPU 70 forms an image on the transfer belt 21 according to predetermined image data.

The image data is stored in a data storage section, not shown, or is transferred from an outside apparatus coupled to the image formation apparatus A.

Then, the control CPU 70 transfers a toner image formed on the transfer belt 21 to the sheet, which is fed from the register roller 16, using the charger 20, and fuses the image in the fuser 23 on the downstream side. Subsequently, the control CPU 70 feeds the sheet with the image formed to the sheet discharge path 22 to transfer to the post-processing apparatus C as described previously.

Further, when a "two-side printing mode" is selected, the control CPU 70 executes the above-mentioned operation to form an image on one side of the sheet, and feeds the sheet to the sheet discharge path 22. At this point, the control CPU 70 causes the post-processing apparatus C to execute the following operation.

The post-processing control CPU 80 of the post-processing apparatus C shifts a guide flapper 22*f* to a solid-line position in FIG. 2 using a detection signal of the sensor such that the sheet front end arrives at the sheet discharge path 22. By this means, the sheet fed to the sheet discharge path 22 is fed from the sheet discharge path 22 to the carrying-out path 29.

Concurrently with the path switching control, when the sheet front end is carried in the processing tray 35 from the carrying-out path 29, the post-processing control CPU 80 shifts the reverse roller 36 from the waiting position Wp to the actuation position Ap, and at the same time, rotates the reverse roller 36. Then, the sheet carried in the processing tray 35 is fed to the downstream side along the processing tray 35 by rotation of the reverse roller 36.

Next, when the post-processing control CPU 80 detects the sheet rear end by the sheet discharge sensor S1, at timing at which the sheet rear end passes through the guide flapper 22*f*, the control CPU 80 shifts the flapper 22*f* to the dashed-line position in FIG. 2, and concurrently, rotates backward the sheet discharge roller 31 of the carrying-out path 29.

Then, the sheet reverses the transport direction, and moves backward (switchback-shifts) to the sheet discharge path 22. By this switchback shift, the sheet is fed to the reverse path 25.

Then, the control CPU 70 of the image formation apparatus A reverses the side of the sheet fed to the reverse path 25 to feed to the register roller 16. Around the time of feeding, the control CPU 70 forms a backside image on the transfer belt 21; forms the image on the backside of the sheet in the charger 20, and carries out the sheet to the sheet discharge path 22.

[Timing Chart]

Figure 12:
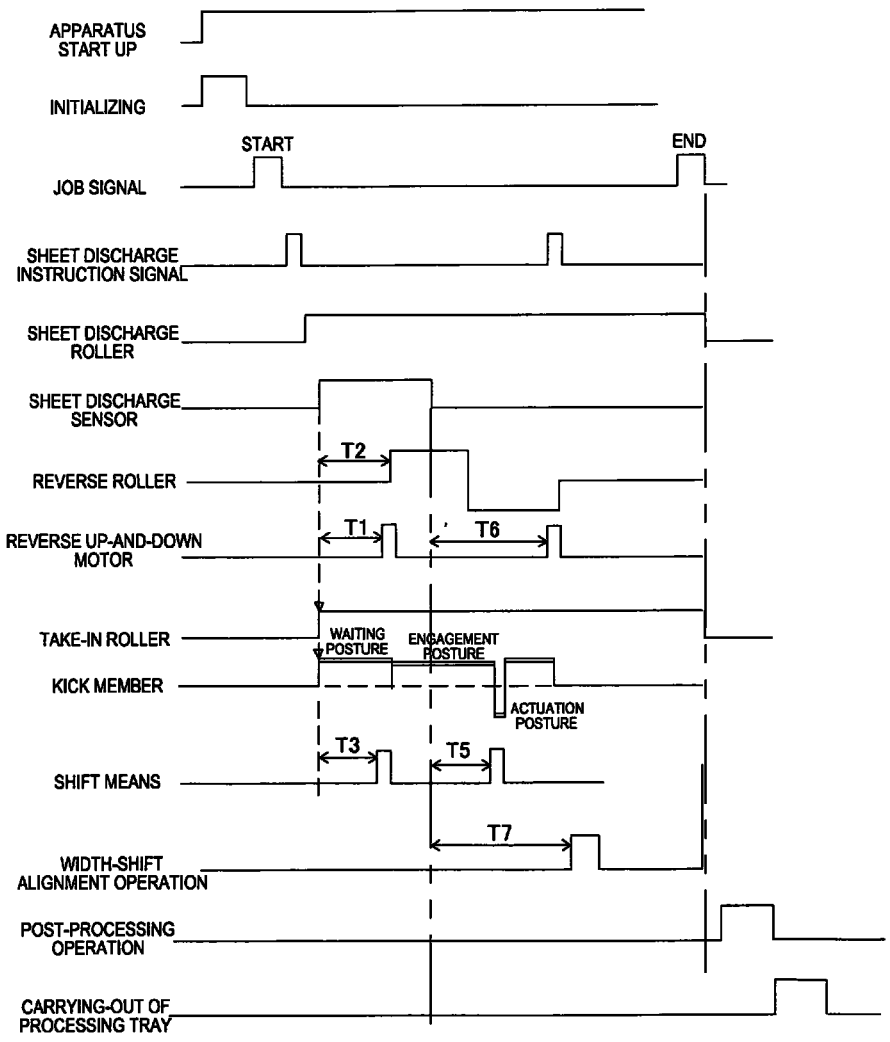
FIG. 12 is a timing chart of sheet discharge operation in the post-processing apparatus of FIG. 2.

The sheet discharge operation will be described next according to a timing chart as shown in FIG. 12. When the apparatus power is turned ON, the control CPU 70 executes initializing operation. The operation is to set an initial state according to the beforehand prepared control program.

Next, the operator sets modes of image formation conditions, post-processing condition and the like on the control panel 78.

The image formation apparatus A forms an image on a sheet according to the set conditions to carry out of the sheet discharge outlet 24. Before the sheet discharge operation, the control CPU 70 issues a sheet discharge instruction signal to the post-processing control CPU 80. Upon receiving the signal, the post-processing control CPU 80 drives and rotates the sheet discharge roller 31 of the carrying-out path 29 and the take-in roller 38.

The rotation direction of each roller is the direction to carry the sheet, a forward/reverse rotation motor M7 drives and rotates the sheet discharge roller 31, and the driving motor M3 drives and rotates the take-in roller 38.

By rotation of each roller, the sheet fed from the image formation apparatus A proceeds in the carrying-out path 29. The sheet proceeds in the carrying-out path 29, and the sheet discharge sensor S1 detects the front end. With reference to a signal that the sheet discharge sensor S1 detects the sheet front end, the timers T1, T2 and T3 are started.

The timer T1 is set for the predicted time the sheet front end passes through the reverse roller position, and the control means (post-processing control CPU 80: the same in the following description) lowers the reverse roller 36 from the waiting position Wp to the actuation position Ap.

The timer T2 is set for around the time the sheet front end passes through the reverse roller position, and when the time has elapsed, the control means 80 rotates the reverser roller 36 in the forward direction. In addition, the timer time T2 is set to be earlier or later than the timer time T1.

In setting to be earlier, rotation is started before the reverse roller 36 is lowered onto the processing tray. In setting to be later, rotation is started after the reverse roller 36 is lowered onto the processing tray.

The timer T3 is set for the predicted time from a detection signal of the sheet discharge sensor S1 with the sheet nipped by both of the reverse roller 36 and sheet discharge roller 31. When the time has elapsed, the control means 80 shifts the kick member 50 from the waiting posture Fa to the engagement posture Fb. The operation is executed by the shift motor M4 (M5, M6) of the shift means 52.

Next, with reference to the time the sheet rear end passes through the sheet discharge sensor S1, the control means 80 starts timers T4, T5 and T6.

The timer T4 is set for the predicted time the sheet rear end passes through the sheet discharge roller 31, and the reverse roller 36 is rotated in the backward direction (sheet-discharge opposite direction). During the time, the kick member 50 drops on the processing tray from the waiting posture Fa to the actuation posture Fc, concurrently with the sheet separating from the sheet discharge roller 31.

At this point, the sheet rear end is forcibly dropped onto sheets stacked on the processing tray.

The timer T5 is to return the kick member 50 from the actuation posture Fc to the waiting posture Fa from the detection signal of the sheet rear end (after the predicted time the kick member 50 changes to the actuation posture Fc). The operation is executed by rotation of the shift motor M4 of the shift means 52.

The timer T6 is set for the predicted time the sheet rear end is taken in the take-in roller 38 from detection of the sheet rear end, and after a lapse of the time, the reverse roller 36 is shifted from the actuation position Ap to the waiting position Wp. Concurrently therewith, rotation of the roller is halted.

The timer T7 is set for the predicted time the sheet rear end is struck against the position regulating stopper 37 from the sheet rear end position, and after a lapse of the time, the sheet side alignment means 39 executes width-shift operation. The operation is performed by the width-shift motor.

Next, upon receiving a job finish signal from the image formation apparatus A, the control means 80 executes the post-processing operation after a lapse of a predicted time the last sheet is collected on the processing tray. The post-processing operation is performed by driving a driver unit of the staple unit 28.

Next, upon receiving an operation finish signal of the post-processing means, the control means 80 carries out the processed sheets on the processing tray to the downstream side. Therefore, the control means 80 lowers the reverse roller 36 from the waiting position Wp to the actuation position Ap, and concurrently, rotates the reverse roller 36 in the forward rotation direction.

By this means, the sheets (bunch) nipped between driven roller 43 and the roller 36 are carried out to the stack tray 40 on the downstream side.

In addition, this application claims priority from Japanese Patent Application No. 2011-223042 incorporated herein by reference.

The invention claimed is:

1. A sheet storage apparatus, comprising:

a sheet discharge outlet for carrying out a sheet sequentially;

a placement tray disposed in a level difference formed on a downstream side of the sheet discharge outlet to place the sheet dropped from the sheet discharge outlet;

a sheet discharge rotating body disposed in the sheet discharge outlet;

a reverse rotating body capable of moving up and down between an actuation position for engaging the sheet on the placement tray and a retracted position retracted upward to switch a transport direction of the sheet;

an alignment rotating body that aligns the sheet dropped from the sheet discharge outlet to a predetermined position on the placement tray; and a kick member disposed between the sheet discharge rotating body and the reverse rotating body to forcibly drop a sheet rear end carried out of the sheet discharge outlet toward the alignment rotating body positioned downward, wherein the kick member is configured to swing among a waiting posture retracted upward from the sheet carried from the sheet discharge outlet to the reverse rotating body, an engagement posture for imposing a load on the sheet nipped by each of the sheet discharge rotating body and the reverse rotating body, and an actuation posture for forcibly dropping the sheet rear end released from the sheet discharge rotating body by a weight of the kick member freely falling, the kick member is coupled to a shift member for changing from the waiting posture to the engagement posture, and the shift member is provided with an engagement portion for holding the kick member in the waiting posture, while changing from the actuation posture to the waiting posture.

2. A sheet storage apparatus, comprising:

a sheet discharge outlet for carrying out a sheet sequentially;

a placement tray disposed in a level difference formed on a downstream side of the sheet discharge outlet to place the sheet dropped from the sheet discharge outlet;

a sheet discharge rotating body disposed in the sheet discharge outlet;

a reverse rotating body capable of moving up and down between an actuation position for engaging the sheet on the placement tray and a retracted position retracted upward to switch a transport direction of the sheet;

an alignment rotating body that aligns the sheet dropped from the sheet discharge outlet to a predetermined position on the placement tray; and a kick member disposed between the sheet discharge rotating body and the reverse rotating body to forcibly drop a sheet rear end carried out of the sheet discharge outlet toward the alignment rotating body positioned downward, wherein the kick member is configured to swing among a waiting posture retracted upward from the sheet carried from the sheet discharge outlet to the reverse rotating body, an engagement posture for imposing a load on the sheet nipped by each of the sheet discharge rotating body and the reverse rotating body, and an actuation posture for forcibly dropping the sheet rear end released from the sheet discharge rotating body by a weight of the kick member freely falling, the kick member is coupled to a shift member for changing from the waiting posture to the engagement posture, the shift member is provided with an engagement portion for holding the kick member in the waiting posture, while changing from the actuation posture to the waiting posture, the shift member comprises a cam disposed between the kick member and a driving motor, and the cam has a wait cam surface for holding the kick member in the waiting posture, and a shift cam surface for changing the kick member from the actuation posture to the waiting posture, while being configured so that the cam and the kick member are mutually in a non-engagement state in the engagement posture.

3. The sheet storage apparatus according to claim 1, wherein a nip force with which the sheet discharge rotating body and the reverse rotating body provide the sheet is set to be higher than a drop force of the sheet imposed by the load of the kick member, and the sheet nipped by each of the sheet discharge rotating body and the reverse rotating body does not slacken by the load of the kick member.

4. The sheet storage apparatus according to claim 1, wherein the reverse rotating body and the sheet discharge rotating body are disposed at a distance shorter than a transport length of the sheet.

5. The sheet storage apparatus according to claim 1, wherein the placement tray is provided with a driven roller in a position for engaging the reverse rotating body, and the reverse rotating body and the driven roller are inclined so that a mutual press-contact direction is inclined to an upstream side in a sheet discharge direction of the sheet.

6. The sheet storage apparatus according to claim 5, wherein the kick member comprises an arm member having a first guide surface and a second guide surface, the first guide surface is formed in a substantially liner shape for guiding the sheet from the sheet discharge outlet to the reverse rotating body, the second guide surface is formed in a substantially curved shape for guiding the sheet dropped onto the placement tray to the alignment rotating body, and in the first guide surface and the second guide surface, transport directions of the sheet to guide are opposite directions.

7. The sheet storage apparatus according to claim 2, wherein the reverse rotating body comprises a roller rotating body that engages an uppermost sheet on the placement tray, a roller driving unit for rotating the roller rotating body in a sheet discharge direction of the sheet and in a sheet-discharge opposite direction, and a roller up-and-down unit for moving the roller rotating body up and down between the actuation position for engaging the sheet on the placement tray and the retracted position, the placement tray is provided with a driven roller disposed in a position for engaging the reverse rotating body, the sheet is nipped by the reverse rotating body and the driven roller to be discharged to a stack tray, the alignment rotating body is provided with an alignment rotating body driving unit for shifting the sheet fed from the reverse rotating body in the sheet-discharge opposite direction, and the roller up-and-down unit comprises a driving motor common to a cam driving unit of the cam for controlling a swing position of the kick member.

8. The sheet storage apparatus according to claim 7, wherein the sheet discharge rotating body is coupled to a sheet discharge rotating body driving unit, and the sheet discharge rotating body driving unit and the alignment rotating body driving unit are driven by a common driving motor.

9. The sheet storage apparatus according to claim 1, wherein a post-processing unit is disposed in the placement tray, while a stack tray is disposed on a downstream side of the placement tray so that the sheet fed from the sheet discharge outlet is temporarily loaded on the placement tray to undergo post-processing, and that the sheet subjected to the processing is stored in the stack tray.

10. The sheet storage apparatus according to claim 1, wherein the reverse rotating body and the alignment rotating body are disposed in the placement tray so as to reverse the transport direction of the sheet that is carried out of the sheet discharge outlet to collect in a post-processing position.

11. An image formation system comprising:

an image formation section that forms an image on a sheet; and a post-processing section that collates and collects sheets from the image formation section to perform post-processing, wherein the post-processing section is provided with a configuration according to claim 1.

12. A sheet storage apparatus, comprising:

a sheet discharge outlet for carrying out a sheet sequentially;

a placement tray disposed in a level difference formed on a downstream side of the sheet discharge outlet to place the sheet dropped from the sheet discharge outlet;

a sheet discharge rotating body disposed in the sheet discharge outlet;

a reverse rotating body capable of moving and down between an actuation position for engaging the sheet on the placement tray and a retracted position retracted upward to switch a transport direction of the sheet;

an alignment rotating body that aligns the sheet dropped from the sheet discharge outlet to a predetermined position on the placement tray; and a kick member disposed between the sheet discharge rotating body and the reverse rotating body to forcibly drop a sheet rear end carried out of the sheet discharge outlet toward the alignment rotating body positioned downward, wherein the kick member is configured to swing among a waiting posture retracted upward from the sheet carried from the sheet discharge outlet to the reverse rotating body, an engagement posture for imposing a load on the sheet nipped by each of the sheet discharge rotating body and the reverse rotating body, and an actuation posture for forcibly dropping the sheet rear end released from the sheet discharge rotating body by a weight of the kick member freely falling, the kick member is coupled to a shift member for changing from the waiting posture to the engagement posture, the shift member is provided with an engagement portion for holding the kick member in the waiting posture, while changing from the actuation posture to the waiting posture, and the engagement portion of the shift member does not engage the kick member at the actuation posture so that the kick member freely falls.

13. A sheet storage apparatus, comprising:

a sheet discharge outlet for carrying out a sheet sequentially;

a placement tray disposed in a level difference formed on a downstream side of the sheet discharge outlet to place the sheet dropped from the sheet discharge outlet;

a sheet discharge rotating body disposed in the sheet discharge outlet;

a reverse rotating body capable of moving up and down between an actuation position for engaging in the sheet on the placement tray and a retracted position retracted upward to switch a transport direction of the sheet;

an alignment rotating body that aligns the sheet dropped from the sheet discharge outlet to a predetermined position on the placement tray; and a kick member disposed between the sheet discharge rotating body and the reverse rotating body to forcibly drop a sheet rear end carried out of the sheet discharge outlet toward the alignment rotating body positioned downward, wherein the kick member is configured to swing among a waiting posture retracted upward from the sheet carried from the sheet discharge outlet to the reverse rotating body, an engagement posture for imposing a load on the sheet nipped by each of the sheet discharge rotating body and the reverse rotating body, and an actuation posture for forcibly dropping the sheet rear end released from the sheet discharge rotating body, the kick member is coupled to a shift member for changing from the waiting posture to the engagement posture, the shift member is provided with an engagement portion for holding the kick member in the waiting posture, while changing from the actuation posture to the waiting posture, the shift member comprises a cam disposed between the kick member and a driving motor, and the cam has a wait cam surface for holding the kick member in the waiting posture, and a shift cam surface for changing the kick member from the actuation posture to the waiting posture, while being configured so that the cam and the kick member are mutually in a non-engagement state in the engagement posture.

* * * * *